US012742303B2

(12) United States Patent
Hatake et al.

(10) Patent No.: US 12,742,303 B2
(45) Date of Patent: Sep. 22, 2026

(54) LOADING MACHINE CONTROL DEVICE, LOADING MACHINE CONTROL METHOD, AND CONTROL SYSTEM

(71) Applicant: Komatsu Ltd., Tokyo (JP)

(72) Inventors: Kazuhiro Hatake, Tokyo (JP); Yusuke Saigo, Tokyo (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 18/848,586

(22) PCT Filed: Jul. 12, 2023

(86) PCT No.: PCT/JP2023/025723

§ 371 (c)(1),
(2) Date: Sep. 19, 2024

(87) PCT Pub. No.: WO2024/024510

PCT Pub. Date: Feb. 1, 2024

(65) Prior Publication Data

US 2025/0223776 A1 Jul. 10, 2025

(30) Foreign Application Priority Data

Jul. 29, 2022 (JP) ..... 2022-121987

(51) Int. Cl.
*E02F 3/43* (2006.01)
*E02F 3/30* (2006.01)

(52) U.S. Cl.
CPC ..... *E02F 3/439* (2013.01); *E02F 3/308* (2013.01)

(58) Field of Classification Search
CPC . E02F 3/439; E02F 3/308; E02F 3/435; E02F 3/43; E02F 9/20

(Continued)

(56) References Cited

U.S. PATENT DOCUMENTS 2,851,171 A * 9/1958 Martin ..... E02F 3/4075 177/139
3,048,287 A * 8/1962 Biedess ..... E02F 3/3486 414/565

(Continued)

FOREIGN PATENT DOCUMENTS

JP H09-195321 A 7/1997
JP 2020-041352 A 3/2020

(Continued)

*Primary Examiner* — B M M Hannan
(74) *Attorney, Agent, or Firm* — Fish & Richardson P.C.

(57) ABSTRACT

A movement control unit, during automated control, performs the processes below. The movement control unit outputs an operation signal for swinging a swinging body until a portion of the swinging body to which work equipment is attached faces a goal position. The movement control unit outputs an operation signal for upwardly actuating a first link component, which is one of multiple link components, when a work tool is positioned above a loading target. The movement control unit outputs an operation signal for downwardly actuating a second link component, which is one of the multiple link components, when the work tool is positioned above the loading target. The movement control unit outputs an operation signal for downwardly actuating the first link component and the second link component when the work tool is not positioned above the loading target.

10 Claims, 12 Drawing Sheets

(58) Field of Classification Search
USPC ..... 701/50
See application file for complete search history.

(56) References Cited

U.S. PATENT DOCUMENTS

| | | | | |
|---|---|---|---|---|
| 3,807,589 | A * | 4/1974 | Shovick | B66C 3/02 37/444 |
| 6,643,577 | B1 * | 11/2003 | Padgett | E02F 9/2012 318/568.18 |
| 12,071,741 | B2 * | 8/2024 | Itoh | E02F 3/435 |
| 2019/0360175 | A1 * | 11/2019 | Myers | E02F 9/26 |
| 2020/0248434 | A1 * | 8/2020 | Konda | E02F 9/2033 |
| 2020/0263385 | A1 * | 8/2020 | Konda | E02F 3/439 |
| 2021/0108394 | A1 * | 4/2021 | Myers | E02F 9/262 |
| 2021/0164192 | A1 | 6/2021 | Konda et al. | |
| 2021/0254304 | A1 * | 8/2021 | Konda | E02F 3/32 |
| 2022/0282460 | A1 * | 9/2022 | Oglesby | E02F 3/439 |
| 2023/0074375 | A1 | 3/2023 | Okuwaki et al. | |

FOREIGN PATENT DOCUMENTS

| | | | |
|---|---|---|---|
| JP | 2021-172972 | A | 11/2021 |
| WO | 2022/070606 | A1 | 4/2022 |

* cited by examiner

LOADING MACHINE CONTROL DEVICE, LOADING MACHINE CONTROL METHOD, AND CONTROL SYSTEM

CROSS-REFERENCE TO RELATED APPLICATIONS

This application is a National Stage application under 35 U.S.C. § 371 of International Application No. PCT/JP2023/025723, filed on Jul. 12, 2023, which claims priority to Japanese Patent Application No. 2022-121987, filed on Jul. 29, 2022. The contents of the prior applications are incorporated herein in their entirety.

TECHNICAL FIELD

The present disclosure pertains to a loading machine control device, a loading machine control method, and a control system.

BACKGROUND ART

Patent Document 1 discloses technology pertaining to semi-automated control of a loading machine. The semi-automated control in Patent Document 1 is control in which, after the loading of a loading target, such as a dump truck, has been completed, excavation instructions are received from an operator, and automated excavation is performed by a control device swinging a loading machine and actuating work equipment.

CITATION LIST

Patent Literature

[Patent Document 1] Japanese Unexamined Patent Application, First Publication No. 2020-041352

SUMMARY OF THE INVENTION

Problems to be Solved by the Invention

According to Patent Document 1, the work equipment is moved downward after a swinging body has swung to an angle at which the work equipment and the loading target do not overlap in a plan view from above, so that the work equipment and the loading target do not come into contact. Therefore, the work equipment movement starting timing is late and time is wasted until a work tool is moved to a goal position such as an excavation position. Meanwhile, there is a demand for being able to move a work tool to a goal position as quickly as possible in order to increase the work efficiency.

An objective of the present disclosure is to provide a loading machine control device, a loading machine control method, and a control system that can shorten the time until a work tool arrives at a goal position during automated control of a loading machine.

Means for Solving the Problems

An aspect disclosed herein is a control device for a loading machine provided with a swinging body that swings about a swing center, a support that supports the swinging body, and work equipment that is composed of multiple link components including a work tool and that is attached to the swinging body. The control device is provided with a movement control unit that performs automated control for automatically moving the work tool from above a loading target to a goal position that is distanced from the loading target and that is lower than the loading target. The movement control unit, during the automated control, outputs an operation signal for swinging the swinging body until a portion of the swinging body to which the work equipment is attached faces the goal position, outputs an operation signal for upwardly actuating a first link component, which is one of the multiple link components, when the swinging body swings and the work tool is positioned above the loading target, outputs an operation signal for downwardly actuating a second link component, which is one of the multiple link components, when the swinging body swings and the work tool is positioned above the loading target, and outputs an operation signal for downwardly actuating the first link component and the second link component when the swinging body swings and the work tool is not positioned above the loading target.

Advantageous Effects of Invention

According to the embodiment described above, the time until a work tool arrives at a goal position during automated control of a loading machine can be shortened.

EXAMPLE EMBODIMENT

First Embodiment

Hereinafter, embodiments will be described in detail with reference to the drawings.

«Structure of Loading Machine 100»

Figure 1:
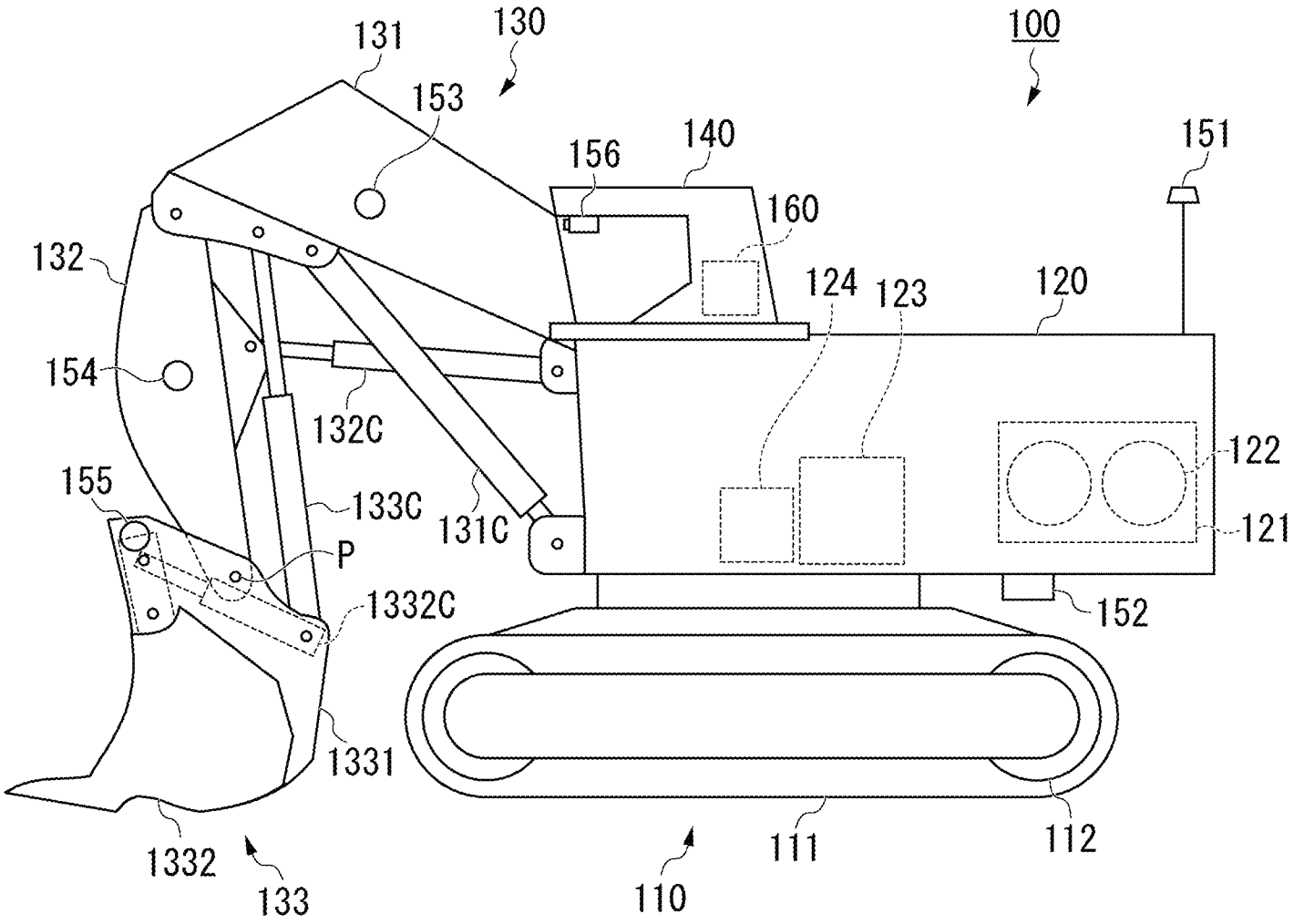
FIG. 1 A schematic diagram illustrating the structure of a loading machine according to a first embodiment.

FIG. 1 is a schematic diagram illustrating the structure of a loading machine 100 according to a first embodiment.

The loading machine 100 operates at a construction site, excavating a construction target such as earth and sand, and loading the earth and sand onto a loading target T such as a dump truck. Examples of the loading machine 100 include a face shovel, a backhoe shovel, and a rope shovel. Additionally, the loading machine 100 may be electrically actuated or may be hydraulically actuated. The loading machine 100 according to the first embodiment is a face shovel. The loading machine 100 is provided with a traveling body 110, a swinging body 120, work equipment 130, and a driver's cab 140.

The traveling body 110 supports the loading machine 100 so as to be able to travel. The traveling body 110 is provided with two endless tracks 111 provided on the left and right, and two travel motors 112 for driving the endless tracks 111. The traveling body 110 is an example of a support portion.

The swinging body 120 is supported on the traveling body 110 so as to be able to swing about a swing center.

The work equipment 130 is hydraulically actuated. The work equipment 130 is supported so as to be able to be actuated in the vertical direction on the front portion of the swinging body 120. The driver's cab 140 is a space that is boarded by an operator to operate the loading machine 100. The driver's cab 140 is provided on the left front portion of the swinging body 120. In this case, the portion of the swinging body 120 to which the work equipment 130 is attached is referred to as the front portion. Additionally, for the swinging body 120, with reference to the front portion, the portion on the opposite side is referred to as the rear portion, the portion on the left side is referred to as the left portion, and the portion on the right side is referred to as the right portion.

«Structure of Swinging Body 120»

The swinging body 120 is provided with an engine 121, a hydraulic pump 122, a control valve 123, and a swing motor 124.

The engine 121 is an engine that is driven by a hydraulic pump 122. The engine 121 is an example of a drive power source.

The hydraulic pump 122 is a variable-capacity pump that is driven by the engine 121. The hydraulic pump 122 supplies hydraulic oil to actuators (a boom cylinder 131C, a stick cylinder 132C, a bucket cylinder 133C, a clam cylinder 1332C, the travel motors 112, and the swing motor 124) via a control valve 123.

The control valve 123 controls the flow rate of the hydraulic oil supplied form the hydraulic pump 122.

The swing motor 124 is driven by the hydraulic oil supplied from the hydraulic pump 122 via the control valve 123, and swings the swinging body 120.

«Structure of Work Equipment 130»

The work equipment 130 is provided with a boom 131, a stick 132, a clam bucket 133 as a work tool, a boom cylinder 131C, a stick cylinder 132C, and a bucket cylinder 133C. Examples of work tools include buckets, tilt buckets, tilt-rotate buckets, etc.

The proximal end of the boom 131 is rotatably attached to the swinging body 120 by a boom pin. In the loading machine 100 illustrated in FIG. 1, the boom 131 is provided at a central portion of the front surface of the swinging body 120. However, there is no limitation thereto, and the boom 131 may be attached so as to be offset in the left or the right direction. In this case, the swing center of the swinging body 120 is not located on the operating plane of the work equipment 130.

The stick 132 connects the boom 131 with the clam bucket 133. The proximal end of the stick 132 is rotatably attached, by a stick pin, to the distal end of the boom 131.

The clam bucket 133 comprises a back wall 1331 rotatably attached to the distal end of the stick 132 by a pin, a clamshell 1332 having blades for excavating earth and sand, etc., and a clam cylinder 1332C for opening and closing the back wall 1331 and the clamshell 1332. The back wall 1331 and the clamshell 1332 are connected, so as to able to open and close, by a pin. When the back wall 1331 and the clamshell 1332 are closed, the back wall 1331 and the clamshell 1332 function as a container for accommodating excavated earth and sand. Conversely, by opening the back wall 1331 and the clamshell 1332, the accommodated earth and sand can be discharged. The proximal end of the clam cylinder 1332C is attached to the back wall 1331. The distal end of the clam cylinder 1332C is attached to the clamshell 1332. The clam bucket 133 is attached so that an opening faces forward relative to the swinging body 120. That is, at the time of excavation, the opening of the clam bucket 133 and the swinging body 120 face in substantially the same direction.

The boom 131, the stick 132, and the clam bucket 133 are examples of link components.

The boom cylinder 131C is a hydraulic cylinder for actuating the boom 131. The proximal end of the boom cylinder 131C is attached to the swinging body 120. The distal end of the boom cylinder 131C is attached to the boom 131.

The stick cylinder 132C is a hydraulic cylinder for actuating the stick 132. The proximal end of the stick cylinder 132C is attached to the boom 131. The distal end of the stick cylinder 132C is attached to the stick 132.

The bucket cylinder 133C is a hydraulic cylinder for actuating the clam bucket 133. The proximal end of the bucket cylinder 133C is attached to the boom 131. The distal end of the bucket cylinder 133C is attached to a link component connected to the back wall 1331.

«Structure of Driver's Cab 140»

Figure 2:
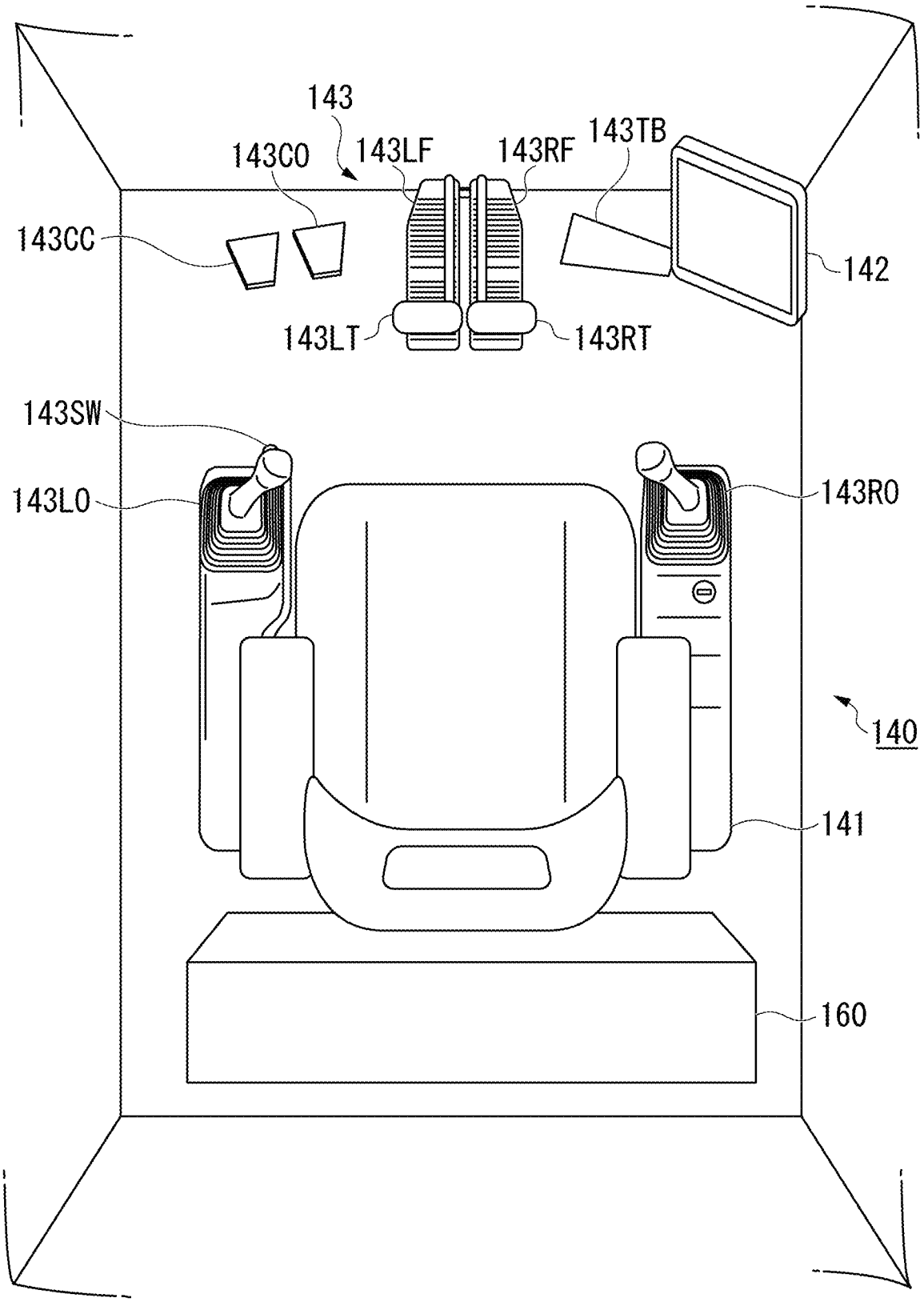
FIG. 2 A diagram illustrating the structure inside a driver's cab according to the first embodiment.

FIG. 2 is a diagram illustrating the structure inside the driver's cab 140 according to the first embodiment.

Inside the driver's cab 140, a driver's seat 141, an operating terminal 142, and an operating device 143 are provided. The operating terminal 142 is provided near the driver's seat 141 and is a user interface with a control device 160 to be described below. The operating terminal 142 is a display device that is composed, for example, of a touch panel, and may have an operating unit that is operated by an operator and an input reception unit that receives the operations. Additionally, the display device may display measurement data from an engine water temperature gauge, a fuel gauge, etc. Additionally, the operating terminal 142 may be provided with a display unit such as an LCD. The touch panel is an example of the display unit.

The operating device 143 is a device for driving the traveling body 110, the swinging body 120, and the work equipment 130 by means of manual operations by the operator. The operating device 143 is provided with a left operation lever 143LO, a right operation lever 143RO, a left foot pedal 143LF, a right foot pedal 143RF, a left travel lever 143LT, a right travel lever 143RT, a clam-opening pedal 143CO, a clam-closing pedal 143CC, a swing brake pedal 143TB, and a starting switch 143SW.

The left operation lever 143LO is provided on the left side of the driver's seat 141. The right operation lever 143RO is provided on the right side of the driver's seat 141.

The left operation lever 143LO is an operating mechanism for performing swinging operations of the swinging body 120 and excavation/dumping operations of the stick 132. Specifically, when the operator of the loading machine 100 tilts the left operation lever 143LO forward, the stick 132 executes a dumping operation. Additionally, when the operator of the loading machine 100 tilts the left operation lever 143LO rearward, the stick 132 executes an excavation operation. Additionally, when the operator of the loading machine 100 tilts the left operation lever 143LO rightward, the swinging body 120 swings to the right. Additionally, when the operator of the loading machine 100 tilts the left operation lever 143LO leftward, the swinging body 120 swings to the left. In other embodiments, the swinging body 120 may swing to the right or swing to the left when the left operation lever 143LO is tilted forward or rearward, and the stick 132 may perform an excavation operation or a dumping operation when the left operation lever 143LO is tilted leftward or rightward.

The right operation lever 143RO is an operating mechanism for performing excavation/dumping operations of the clam bucket 133 and raising/lowering operations of the boom 131. Specifically, when the operator of the loading machine 100 tilts the right operation lever 143RO forward, the boom 131 executes a lowering operation. Additionally, when the operator of the loading machine 100 tilts the right operation lever 143RO rearward, the boom 131 executes a raising operation. Additionally, when the operator of the loading machine 100 tilts the right operation lever 143RO rightward, the clam bucket 133 performs a dumping operation. Additionally, when the operator of the loading machine 100 tilts the right operation lever 143RO leftward, the clam bucket 133 performs an excavation operation. In other embodiments, the clam bucket 133 may perform a dumping operation or an excavation operation when the right operation lever 143RO is tilted forward or rearward, and the boom 131 may perform a raising operation or a lowering operation when the right operation lever 143RO is tilted leftward or rightward.

The left foot pedal 143LF is disposed on the left side of the floor surface in front of the driver's seat 141. The right foot pedal 143RF is disposed on the right side of the floor surface in front of the driver's seat 141. The left travel lever 143LT is borne on the left foot pedal 143LF and is configured so that the inclination of the left travel lever 143LT is linked with the depression of the left food pedal 143LF. The right travel lever 143RT is borne on the right foot pedal 143RF and is configured so that the inclination of the right travel lever 143RT is linked with the depression of the right foot pedal 143RF.

The left foot pedal 143LF and the left travel lever 143LT correspond to the rotational driving of the left-side crawler track of the traveling body 110. Specifically, when the operator of the loading machine 100 tilts the left foot pedal 143LF or the left travel lever 143LT forward, the left-side crawler track rotates in the forward direction. Additionally, when the operator of the loading machine 100 tilts the left foot pedal 143LF or the left travel lever 143LT rearward, the left-side crawler track rotates in the reverse direction.

The right foot pedal 143RF and the right travel lever 143RT correspond to the rotational driving of the right-side crawler track of the traveling body 110. Specifically, when the operator of the loading machine 100 tilts the right foot pedal 143RF or the right travel lever 143RT forward, the right-side crawler track rotates in the forward direction. Additionally, when the operator of the loading machine 100 tilts the right foot pedal 143RF or the right travel lever 143RT rearward, the right-side crawler track rotates in the reverse direction.

The clam-opening pedal 143CO and the clam-closing pedal 143CC are disposed on the left side of the left foot pedal 143LF. The clam-opening pedal 143CO is disposed on the right side of and adjacent to the clam-closing pedal 143CC. When the clam-opening pedal 143CO is depressed, the clam bucket 133 opens at a rate in accordance with the depression level. When the clam-closing pedal 143CC is depressed, the clam bucket 133 closes at a rate in accordance with the depression level.

The swing brake pedal 143TB is disposed on the right side of the right foot pedal 143RF. When the swing brake pedal 143TB is depressed, the relief pressure of a hydraulic circuit connecting the control valve 123 with the swing motor 124 is increased. Specifically, when the swing brake pedal 143TB is depressed, a solenoid of a variable relief valve provided on the hydraulic circuit connecting the control vale 123 with the swing motor 124 is excited, thereby increasing the relief pressure of the variable relief valve. As a result thereof, the braking force on the swinging can be increased.

The starting switch 143SW is provided, for example, on a handle portion of the left operation lever 143LO. The starting switch 143SW may be disposed so as to be located near the operator seated in the driver's seat 141. When the starting switch 143SW is depressed, an automated control instruction signal is output to the control device 160. Upon receiving an automated control instruction signal that has been input, the control device 160 starts automated control.

Automated control refers to the loading machine 100 autonomously controlling the actuation of the work equipment 130 and the swinging body 120 in order to realize prescribed operations. The automated control in the first embodiment is control for the loading machine 100 to autonomously perform a series of operations for swinging the swinging body 120 until it faces a loading target T while raising the boom 131 in order to load excavated earth and sand, opening the clam bucket 133 above the loading target T, then swinging the swinging body 120 to a prescribed orientation while lowering the boom 131 for the next excavation. The automated control according to another embodiment may not involve performing an operation for loading excavated earth and sand. For example, the automated control according to another embodiment may be control for autonomously performing operations for lowering the clam bucket 133, which is positioned above the loading target T, to a prescribed position for the next excavation. In this case, the excavated earth and sand loading operation may be performed by means of manual operations by the operator. Hereinafter, a swinging operation from the orientation (initial orientation) in which the swinging body 120 is facing when the starting switch 143SW is pressed to the orientation facing the loading target T will be referred to as a "first swing", and a swinging operation from the orientation facing the loading target T to the initial orientation will be referred to as a "second swing". In the first embodiment, the initial orientation is the goal orientation of the second swing. In other embodiments, there is no limitation thereto, and an orientation designated in advance by the operator may be set as the goal orientation of the second swing. Additionally, in automated control, the work equipment 130 is actuated so that the postures of the work equipment 130 at the time the first swing and the second swing end are prescribed goal postures. The goal posture of the first swing is a posture in which the clam bucket 133 is positioned above the loading target T and the opening of the clam bucket 133 faces upward. The goal posture of the second swing is an excavation preparation posture in which the clam bucket 133 is positioned near the excavation target and the opening of the clam bucket 133 faces forward. In other embodiments, the goal posture of the second swing may be the posture (initial posture) of the work equipment 130 when the starting switch 143SW was pressed, or may be a posture that has been determined in advance. Normally, the excavation target is at a position lower than the height of the loading target T. For this reason, the loading machine 100 controls the actuation of the work equipment 130 so that the loading target T and the work equipment 130 do not come into contact during the first swing and the second swing. The automated control will be explained in detail below.

«Structure of Measurement System»

As illustrated in FIG. 1, the loading machine 100 is provided with a position/orientation calculator 151, an inclination measurer 152, a boom angle sensor 153, a stick angle sensor 154, a bucket angle sensor 155, and a detection device 156.

The position/orientation calculator 151 calculates the position of the swinging body 120 and the orientation of the swinging body 120. The position/orientation calculator 151 is provided with two receivers that receive positioning signals from an artificial satellite making up a GNSS. The two receivers are installed at respectively different locations on the swinging body 120. The position/orientation calculator 151 detects the position of a representative point (the origin of a shovel coordinate system) on the swinging body 120 in a site coordinate system based on the positioning signals received by the receivers.

The position/orientation calculator 151 uses the respective positioning signals received by the two receivers to calculate the orientation of the swinging body 120 in terms of the relationship between the installation position of one receiver with respect to the installation position of the other receiver. The orientation of the swinging body 120 is in a direction orthogonal to the front surface of the swinging body 120, and is equivalent to the horizontal component of the extension direction of a straight line extending from the boom 131 to the clam bucket 133 of the work equipment 130.

The inclination measurer 152 measures the acceleration and angular velocity of the swinging body 120, and detects the posture (e.g., the roll angle, the pitch angle, and the yaw angle) and the swing velocity of the swinging body 120 based on the measurement results. The inclination measurer 152 is installed, for example, on the lower surface of the swinging body 120. As the inclination measurer 152, for example, an inertial measurement unit (IMU) can be used.

The boom angle sensor 153 is attached to the boom 131 and detects the inclination angle of the boom 131.

The stick angle sensor 154 is attached to the stick 132 and detects the inclination angle of the stick 132.

The bucket angle sensor 155 is attached to the back wall 1331 of the clam bucket 133 and detects the inclination angle of the clam bucket 133.

The boom angle sensor 153, the stick angle sensor 154, and the bucket angle sensor 155 according to the first embodiment detect the inclination angles with respect to the horizontal plane. The angle sensors according to other embodiments are not limited to the above, and may detect the inclination angle relative to other reference planes. For example, in other embodiments, the angle sensors may detect relative rotation angles by means of potentiometers provided at the proximal ends of the boom 131, the stick 132, and the clam bucket 133, or the cylinder lengths of the boom cylinder 131C, the stick cylinder 132C, and the bucket cylinder 133C may be measured and the cylinder lengths may be converted to angles in order to detect the inclination angles.

The detection device 156 detects the three-dimensional positions of objects located in the periphery of the loading machine 100. Examples of the detection device 156 include stereo cameras, laser scanners, UWB (Ultra-Wide Band) ranging devices, etc. The detection device 156 is provided so that the detection direction faces forward, on an upper portion of the driver's cab 140. The detection device 156 may be provided anywhere so long as it is able to capture images of the periphery of the loading machine 100. For example, it may be provided on a side wall, etc. of the swinging body 120 outside the driver's cab 140. Additionally, the detection direction need not be in the forward direction. The detection device 156 identifies the three-dimensional positions of objects with a coordinate system that is based on the position of the detection device 156.

The loading machine 100 according to another embodiment may be provided with multiple detection devices 156.

«Structure of Control Device 160»

Figure 3:
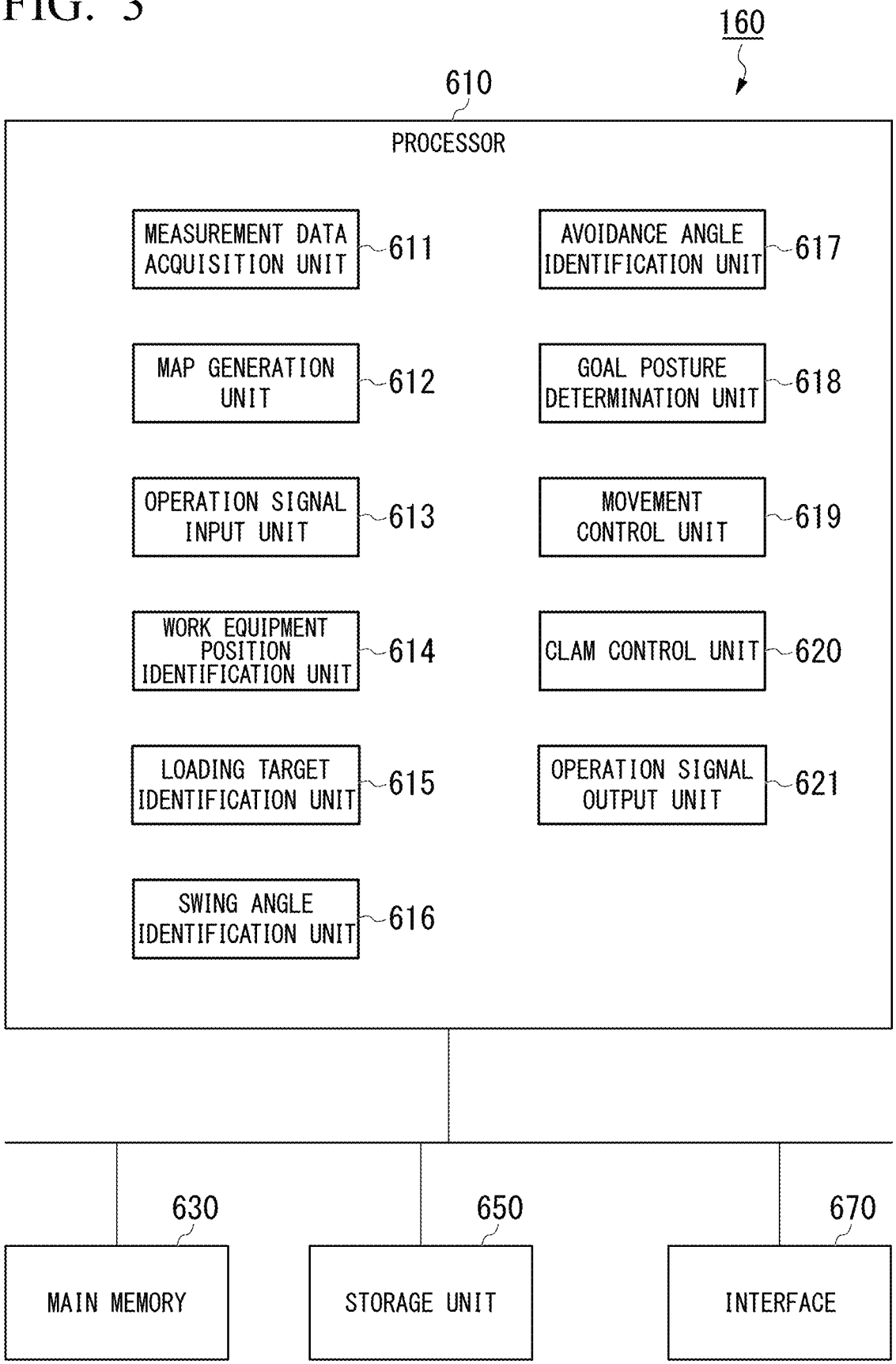
FIG. 3 A schematic block diagram illustrating the structure of a control device according to the first embodiment.

FIG. 3 is a schematic block diagram illustrating the structure of the control device 160 according to the first embodiment.

The loading machine 100 is provided with a control device 160. The control device 160 may be mounted on the operating terminal 142, may be provided separately from the operating terminal 142, or may receive inputs/outputs from the operating terminal 142. The control device 160 receives operation signals from the operating device 143. The control device 160 actuates the work equipment 130, the swinging body 120, and the traveling body 110 by outputting received operation signals or operation signals generated for automated control to a control valve 123. The operation signals generated for automated control comprise operation signals for actuating the swinging body 120 and the work equipment 130, but do not include operation signals for driving the traveling body 110. If an operation signal for driving the traveling body 110 is received from the operating terminal 143 operated by an operator during automated control, the control device 160 stops the automated control.

The control device 160 is a computer provided with a processor 610, a main memory 630, a storage unit 650, and an interface 670. The storage unit 650 stores a program. The processor 610 reads the program from the storage unit 650, loads it in the main memory 630, and executes processes in accordance with the program.

Examples of the storage unit 650 include semiconductor memory, magnetic discs, magneto-optic discs, optical discs, etc. The storage unit 650 may be internal media directly connected to a common communication line in the control device 160, or may be external media connected to the control device 160 via an interface 670. The main memory 630 and the storage unit 650 are non-transitory, tangible storage media.

The processor 610, by executing the program, provides a measurement data acquisition unit 611, a map generation unit 612, an operation signal input unit 613, a work equipment position identification unit 614, a loading target identification unit 615, a swing angle identification unit 616, an avoidance angle identification unit 617, a goal posture determination unit 618, a movement control unit 619, a clam control unit 620, and an operation signal output unit 621.

The measurement data acquisition unit 611 acquires measurement data obtained by a measurement system of the loading machine 100. Specifically, the measurement data acquisition unit 611 acquires measurement data from the position/orientation calculator 151, the inclination measurer 152, the boom angle sensor 153, the stick angle sensor 154, the bucket angle sensor 155, and the detection device 156. The measurement data acquisition unit 611 computes the angle of the swinging body 120 by integrating the angular velocity of the swinging body 120 measured by the inclination measurer 152.

The match generation unit 612 uses the measurement data acquired from the detection device 156 to generate map data representing the periphery of the loading machine 100. The map generation unit 612 generates map data by means of, for example, SLAM (Simultaneous Localization and Mapping) technology. The map data is represented by a vehicle body coordinate system. The vehicle body coordinate system is an orthogonal coordinate system having the swing center of the swinging body 120 as the origin, and having an axis extending in the front-rear direction, an axis extending in the left-right direction, and an axis extending in the up-down direction. Since the detection device 156 is fixed to the swinging body 120, the map generation unit 612 can generate map data for the vehicle body coordinate system by parallel translation of SLAM calculation results on the basis of the positional relationship between the swing center and the detection device 156. The map data generated by the map generation unit 612 is recorded in the main memory 630.

The operation signal input unit 613 receives, from the operating device 143, inputs of operation signals from manual operations by the operator. The operation signals include actuation signals for raising operations and lowering operations of the boom 131, actuation signals for raising operations and lowering operations of the stick 132, actuation signals for dumping operations and excavation operations of the clam bucket 133, actuation signals for opening/closing operations of the clam bucket 133, actuation signals for swinging operations of the swinging body 120, actuation signals for traveling operations of the traveling body 110, and automated control instruction signals of the loading machine 100.

The work equipment position identification unit 614, based on the measurement data acquired by the measurement data acquisition unit 611, identifies a position P (FIG. 4) at the tip of the stick 132 in the vehicle body coordinate system with reference to the swinging body 120 and the height H (FIG. 4) from the tip of the stick 132 to the lowest point on the clam bucket 133. The lowest point on the clam bucket 133 refers to the point, on the outer shape of the clam bucket 133, at the shortest distance from the ground surface.

The work equipment position identification unit 614 identifies the height H (FIG. 4) from the tip of the stick 132 to the lowest point on the clam bucket 133. The lowest point on the clam bucket 133 refers to the point, on the outer shape of the clam bucket 133, at the shortest distance from the ground surface. However, the reference point on the clam bucket 133 identified by the work equipment position identification unit 614 need not be the lowest point. For example, the work equipment position identification unit 614 according to another embodiment may identify, as the reference point, a prescribed position that has been determined in advance on the back surface, etc. of the bucket.

The work equipment position identification unit 614 determines the vertical direction component and the horizontal direction component of the length of the boom 131 based on the inclination angle of the boom 131 and the known length (the distance from the pin on the proximal end to the pin on the distal end) of the boom 131. Similarly, the work equipment position identification unit 614 determines the vertical direction component and the horizontal direction component of the length of the stick 132. The work equipment position identification unit 614 identifies, as the position P at the tip of the stick 132, a position that is distanced from the position of the loading machine 100 by the sum of the vertical components and the sum of the horizontal components of the lengths of the boom 131 and the stick 132 in directions identified from the orientation and posture of the loading machine 100. Additionally, the work equipment position identification unit 614 identifies the lowest point, in the vertical direction, on the clam bucket 133 on the basis of the inclination angle of the clam bucket 133 and the known shape of the clam bucket 133, and identifies the height H from the tip of the stick 132 to the lowest point and the horizontal distance D (FIG. 4) from the tip to the lowest point.

The loading target identification unit 615 determines a loading point based on the map data generated by the map generation unit 612 when an automated control instruction signal is input to the operation signal input unit 613. The loading point is the goal position of a first swing in the automated control, and is a position higher than the loading target T (for example, a vessel of a dump truck). Specifically, the loading target identification unit 615 identifies the position and the shape of the loading target T from the map data and the known shape of the loading target T. The identified data may include height data indicating the height of the loading target T from the ground surface. For example, the loading target identification unit 615 identifies the position and shape of the loading target T from the map data by means of three-dimensional pattern matching. Additionally, for example, the loading target identification unit 615 may identify the position and shape of a loading target T such as a dump truck located in the periphery of the loading machine 100 from measurement data or image capture data from the detection device 156 rather than map data. The loading target identification unit 615 determines a loading point based on the center point of the upper surface of the identified loading target T and the shape of the clam bucket 133.

The swing angle identification unit 616 identifies, as a goal swing angle, the angle between the orientation at which the loading point is located and the initial orientation of the swinging body 120 when the automated control instruction signal is input to the operation signal input unit 613. The swing angle identification unit 616 identifies, as the goal swing angle, the angle between a line segment extending from the swing center of the swinging body 120 to the loading point and a line segment extending from the swing center of the swinging body 120 to the position of the tip of the stick 132 identified by the work equipment position identification unit 614 when automated control is initiated.

The avoidance angle identification unit 617 identifies an interference avoidance angle based on the position and shape of the loading target T identified by the loading target identification unit 615. The interference avoidance angle is a swing angle at which the work equipment 130 and the loading target T do not overlap in a plan view from above. Specifically, the avoidance angle identification unit 617 identifies the interference avoidance angle by the procedure below.

The avoidance angle identification unit 617 identifies, on the external shape of the loading target T, the rearmost point $p_1$ (FIG. 4) in the swing direction of the swinging body 120, based on the position and the shape of the loading target T identified by the loading target identification unit 615. The avoidance angle identification unit 617 determines a first angle $\phi_1$ (FIG. 4) formed between a line segment extending from the swing center of the swinging body 120 to the position of the tip of the stick 132 at the time automated control is initiated, and a line segment extending from the swing center of the swinging body 120 to the identified point on the external shape of the loading target T. The avoidance angle identification unit 617 identifies, on the external shape of the clam bucket 133, the forwardmost point $p_2$ (FIG. 4) in the swing direction of the swinging body 120, based on the position of the tip of the stick 132 identified by the work equipment position identification unit 614 and the known shape of the clam bucket 133. The avoidance angle identification unit 617 determines a second angle $\phi_2$ formed between a line segment extending from the swing center of the swinging body 120 to the position of the tip of the stick 132, and a line segment extending from the swing center of the swinging body 120 to the identified point $p_2$ on the external shape of the clam bucket 133. The avoidance angle identification unit 617 determines a first interference avoidance angle $\theta_1$ (FIG. 4) by further subtracting, from the difference between the first angle $\phi_1$ and the second angle $\phi_2$, a third angle $\phi_3$, which is a control margin. The first interference avoidance angle $\theta_1$ is an interference avoidance angle with reference to the initial position of the clam bucket 133. For this reason, in the second swing for moving the clam bucket 133 from the loading point to the initial position, the control device 160 controls the work equipment 130 based on the second interference avoidance angle $\theta_2$ (FIG. 5), which is the difference between the goal swing angle and the first interference avoidance angle $\theta_1$.

The goal posture determination unit 618 calculates the posture of the work equipment 130 when the tip of the stick 132 is positioned at the loading point, on the basis of the height and the distance from the swing center to the loading point determined by the loading target identification unit 615, and determines the goal posture of the work equipment 130 for the first swing. Additionally, the goal posture determination unit 618 determines the goal posture of the work equipment 130 for the second swing by reading out the excavation preparation posture pre-stored in the storage unit 650, etc. The goal posture is represented, for example, by the tip of the boom 131, the tip of the stick 132, and the position of a blade tip of the clam bucket 133 in the vehicle body coordinate system. The posture of the work equipment 130 includes the position and the angle of each component making up the work equipment 130, in the vehicle body coordinate system.

The movement control unit 619 illustrated in FIG. 3, when the operation signal input unit 613 has received an input automated control instruction signal, generates operation signals for realizing a first swing to move the clam bucket 133 to the loading point, and after the clam bucket 133 has arrived at the loading point, generates operation signals for realizing a second swing to move the clam bucket 133 near the next excavation position or to a prescribed position that has been determined in advance. At this time, the movement control unit 619 controls the swinging body 120 and the work equipment 130 so as not to come into contact with the loading target T and the work equipment 130, on the basis of the interference avoidance angle. The movement control unit 619 according to another embodiment may generate operation signals for realizing the first swing and not generate operation signals for realizing the second swing. Additionally, the movement control unit 619 according to another embodiment may not generate operation signals for realizing the first swing and generate operation signals for realizing the second swing.

Specifically, if the height of the clam bucket 133 does not reach the height of the loading point by the time that the swing angle of the swinging body 120 reaches the first interference avoidance angle $\theta_1$ during the first swing, the movement control unit 619 does not generate swing operation signals for the swinging body 120, and only generates operation signals for the work equipment 130. On the other hand, if the height of the clam bucket 133 reaches the height of the loading point by the time that the swing angle due to swinging reaches the first interference avoidance angle $\theta_1$, the movement control unit 619 generates swing operation signals for the swinging body 120 and operation signals for the work equipment 130 to realize composite operations of the swinging body 120 and the work equipment 130. After the height of the clam bucket 133 has reached the height of the loading point, the movement control unit 619 swings the swinging body 120 without moving the work equipment 130.

Additionally, the movement control unit 619 implements control so that the lowest point on the clam bucket 133 is not lowered until the swing angle of the swinging body 120 reaches the second interference avoidance angle $\theta_2$ during the second swing. The control such that the lowest point is not lowered may be control for maintaining the height of the lowest point or may be control for providing a gap between the loading target T and the clam bucket 133 by raising the lowest point relative to the lowest point before control. At this time, the movement control unit 619 generates operation signals for raising the boom 131 by a prescribed height and generates operation signals for lowering the stick 132 and the clam bucket 133 by the prescribed height. That is, the movement control unit 619 controls the stick 132 and the clam bucket 133 so as to cancel out the variation in the height of the lowest point on the clam bucket 133 due to the raising of the boom 131. After the swing angle has reached the second interference avoidance angle $\theta_2$, the movement control unit 619 generates swing operation signals for the swinging body 120 and operation signals for the work equipment 130 to realize composite operations of the swinging body 120 and the work equipment 130.

The clam control unit 620 generates operation signals for opening the clam bucket 133 when the tip of the stick 132 has arrived at the loading point in the first swing. Additionally, the clam control unit 620 generates operation signals for closing the clam bucket 133 when the swing angle of the swinging body 120 has exceeded the second interference avoidance angle $\theta_2$ in the second swing. The clam control unit 620 may generate operation signals for opening the clam bucket 133 when the clam bucket 133 and the loading target T overlap in a plan view from above, even before the tip of the stick 132 reaches the loading point. Additionally, if there is a sufficient gap between the loading target T and the clam bucket 133, the clam control unit 620 may generate operation signals for closing the clam bucket 133 before the second interference avoidance angle $\theta_2$ is exceeded, i.e., while above the loading target T. The clam bucket 133 is only required to be closed by the time the movement of the boom 131, the stick 132, and the clam bucket 133 is completed.

The operation signal output unit 621 outputs operation signals input to the operation signal input unit 613 or operation signals generated by the movement control unit 619. Specifically, the operation signal output unit 621 outputs operation signals generated by the movement control unit 619 in the case in which automated control is being implemented, and outputs operation signals input to the operation signal input unit 613 in the case in which automated control is not being implemented.

«Operations at Time of Automated Control»

The activity of the loading machine 100 at the time of automated control according to the first embodiment will be explained with reference to the drawings.

Figure 4:
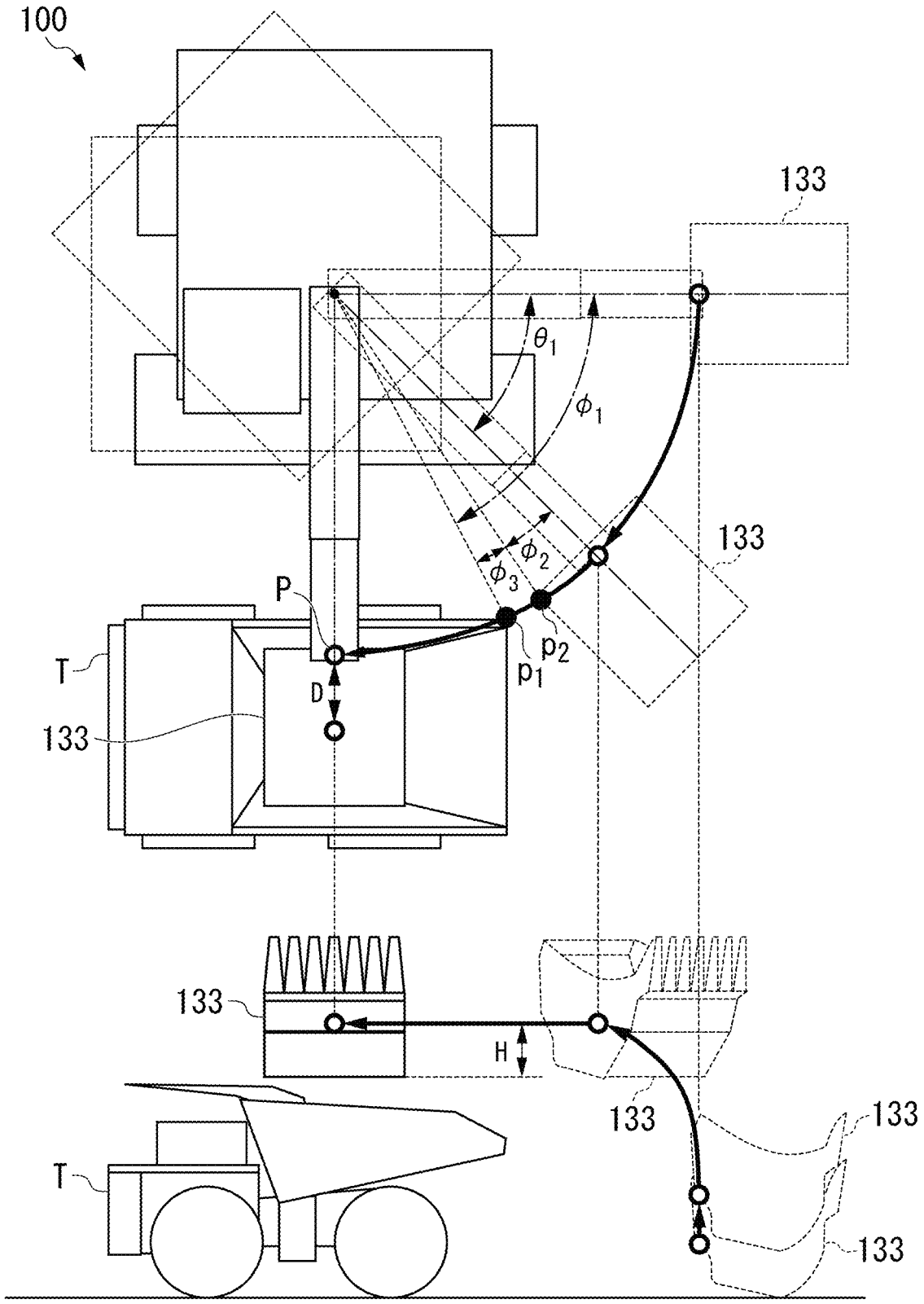
FIG. 4 A diagram illustrating an example of the movement of the loading machine in a first swing according to the first embodiment.
Figure 5:
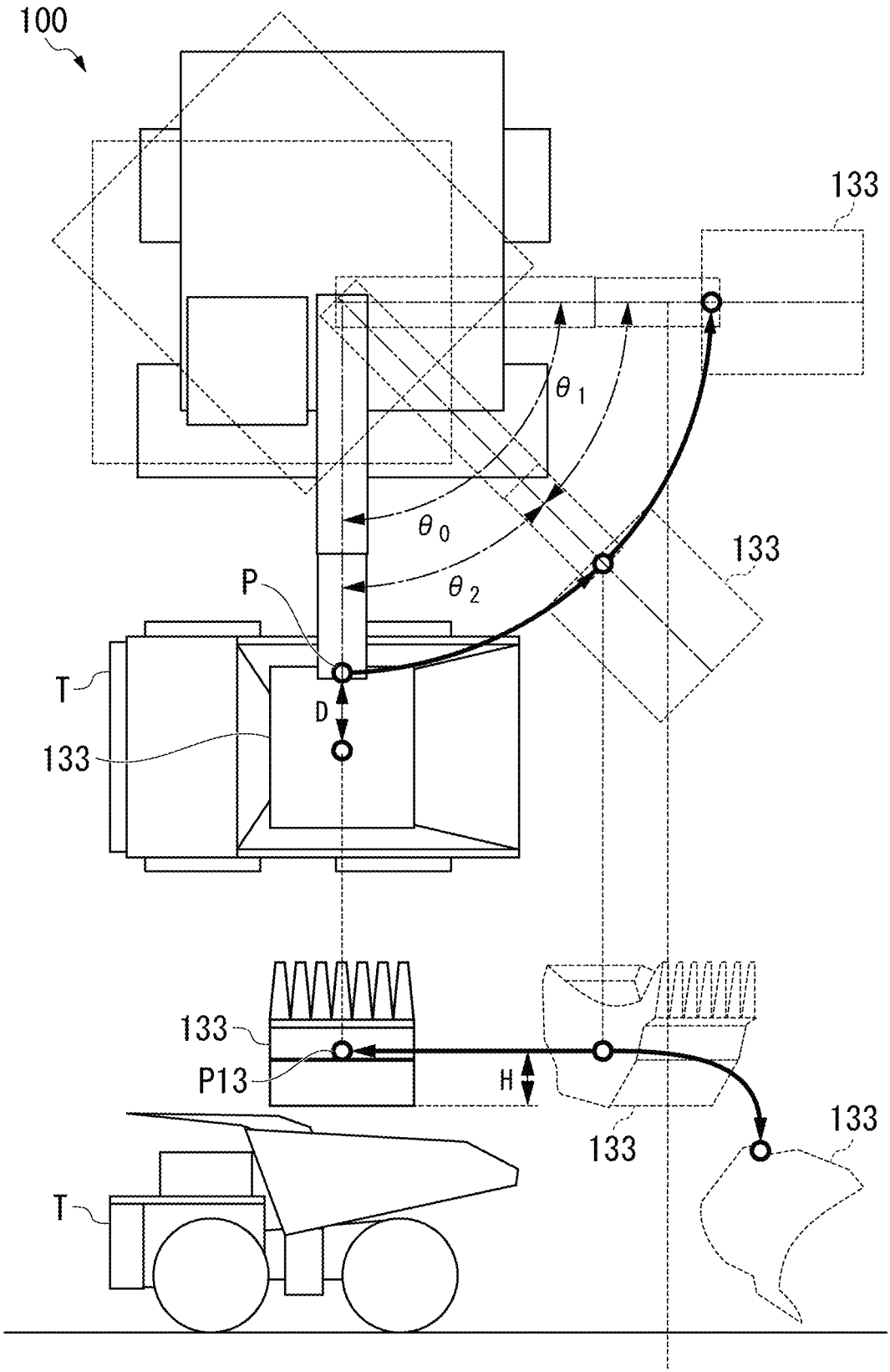
FIG. 5 A diagram illustrating an example of the movement of the loading machine in a second swing according to the first embodiment.

FIG. 4 is a diagram illustrating an example of the activity of the loading machine 100 during the first swing according to the first embodiment. FIG. 5 is a diagram illustrating an example of the activity of the loading machine 100 during the second swing according to the first embodiment.

When automated control is initiated, as illustrated in FIG. 4, the control device 160 first initiates actuation of the work equipment 130 (the boom 131, the stick 132, and the clam bucket 133) and moves the clam bucket 133 upward. That is, the control device 150 initiates the first swing. The goal position of the clam bucket 133 for the first swing is the loading point above the loading target T. After a delay, the control device 160 initiates swinging of the swinging body 120. The control device 160 adjusts the swing initiation timing so that the posture of the work equipment 130 becomes the goal posture for the first swing by the time the swing angle of the swinging body 120 becomes aligned with the first interference avoidance angle $\theta_1$. If the posture of the work equipment 130 becomes the goal posture of the first swing, i.e., if the height of the lowest point on the clam bucket 133 is higher than the upper surface of the loading target T, by the time the swing angle of the swinging body 120 becomes aligned with the first interference avoidance angle $\theta_1$, the work equipment 130 will not come into contact with the loading target T due to the swinging of the swinging body 120. Thereafter, when the clam bucket 133 arrives at the loading point, the control device 160 opens the clam bucket 133 and initiates earth and sand discharge.

Figure 6:
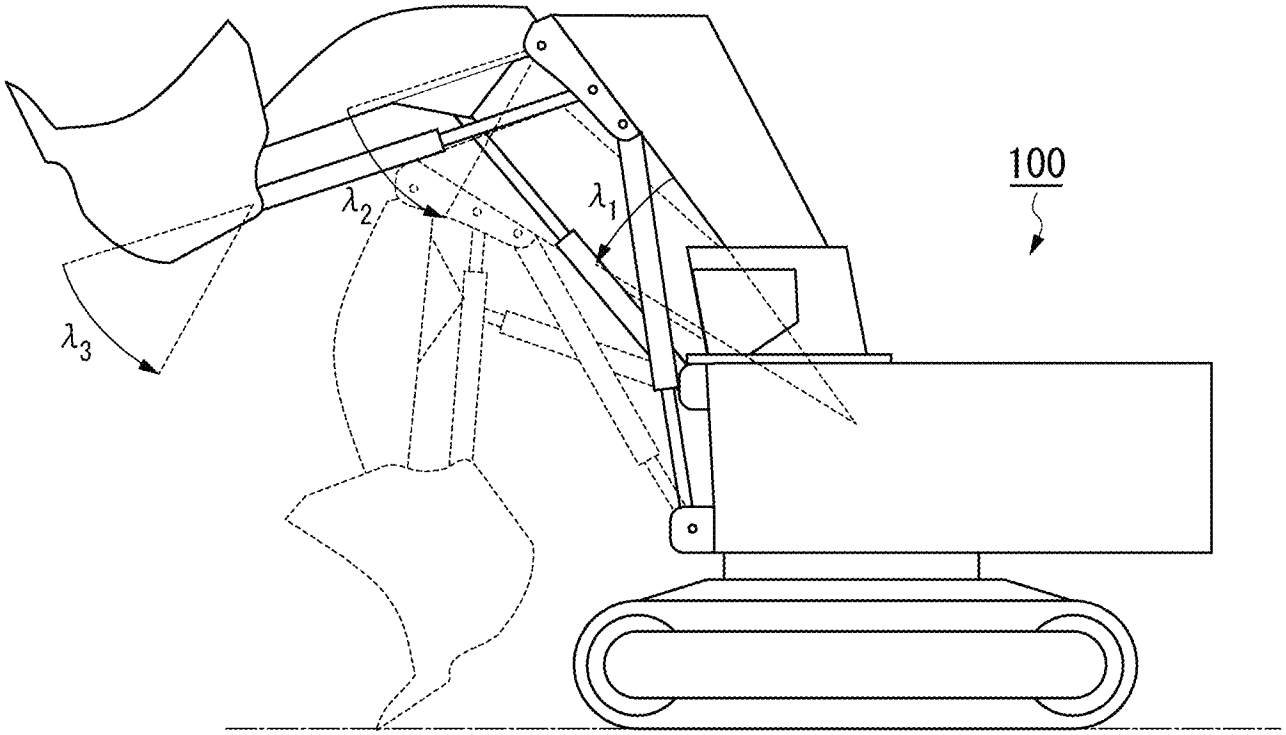
FIG. 6 A diagram illustrating an example of the change in the posture of work equipment in the second swing.

When a certain time period elapses after earth and sand discharge is initiated, the control device 160 initiates the second swing, as illustrated in FIG. 5. The goal position of the clam bucket 133 for the second swing is the position of the clam bucket 133 when the swinging body 120 is facing the direction at the time automated control was initiated and the work equipment 130 has the excavation preparation posture. The goal position of the clam bucket 133 for the second swing is a position that is distanced from the loading target T in a plan view from above and that is lower than the loading target T. The control device 160 maintains the height of the lowest point on the clam bucket 133 until the swing angle of the swinging body 120 exceeds the second interference avoidance angle $\theta_2$. During this time, the control device 160 raises the boom 131 and lowers the stick 132 and the clam bucket 133. This is because the time required for the posture of the work equipment 130 to reach the goal posture is shortened by pre-lowering the stick 132 and the clam bucket 133, which have relatively long lowering actuation times for realizing the goal posture, before the swing angle arrives at the second interference avoidance angle $\theta_2$. FIG. 6 is a diagram illustrating an example of the change in the posture of the work equipment 130 during the second swing.

As illustrated in FIG. 6, when changing the posture of the work equipment 130 to an excavation preparation posture after discharging the earth and sand, the actuation time associated with the downward actuation amount $\lambda 2$ of the stick 132 and the actuation time associated with the downward actuation amount $\lambda s$ of the clam bucket 133 are longer than the actuation time associated with the downward actuation amount M of the boom 131. The actuation times associated with the downward actuation amounts 21, 22, and 23 are examples of required actuation time periods. Normally, a face shovel excavates earth and sand by pushing a clam bucket 133 forward. Therefore, the clam bucket 133 is positioned near the swinging body 120 at the time excavation is initiated. For this reason, at the time excavation is initiated, the stick 132 has a posture in which the angle with respect to the ground is close to perpendicular, and the boom 131 has a posture that is raised by the heights of the stick 132 and the clam bucket 133. For this reason, the actuation amount for a lowering operation of the stick 132 when changing the posture to the next excavation preparation posture after earth and sand discharge is usually greater than the actuation amount for a lowering operation of the boom 131. Although the actuation amount of the clam bucket 133 is not large relative to that of the stick 132 when changing the posture of the work equipment 130 to the excavation preparation posture after earth and sand discharge, since the bucket cylinder 133C for actuating the clam bucket 133 is connected to the boom 131, the actuation amount of the bucket cylinder 133C becomes about the same as that of the stick cylinder 132C. When the swing angle of the swinging body 120 exceeds the second interference avoidance angle $\theta_2$, the control device 160 actuates all of the boom 131, the stick 132, and the clam bucket 133. When the swing angle of the swinging body 120 reaches the goal swing angle $\theta_0$, the control device 160 ends the actuation of the swinging body 120. Additionally, when the posture of the work equipment 130 becomes the goal posture determined at the time the excavation was initiated, the control device 160 ends the actuation of the work equipment 130.

Although FIG. 4 and FIG. 5 illustrate that positional relationship between the excavation position and the loading target T being such as to be at an angle of approximately 90° about the swinging body 120, there is no limitation thereto in other embodiments. For example, in another embodiment, the positional relationship between the excavation position and the loading target T may be another swing angle position, such as an angle of approximately 180° about the swinging body 120.

Figure 7:
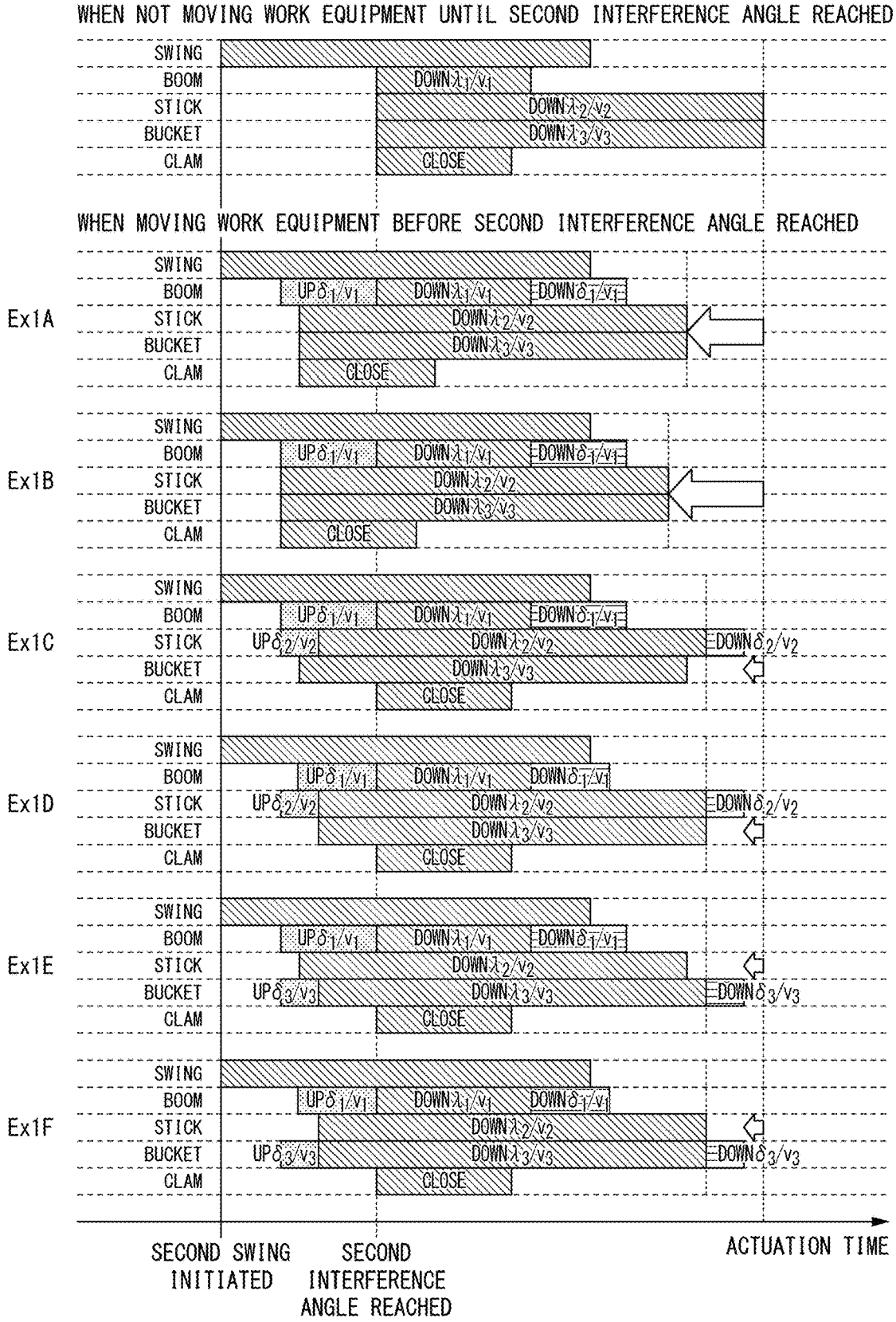
FIG. 7 A diagram indicating second swing time shortening effects according to the first embodiment.

FIG. 7 is a diagram indicating the second swing time shortening effects according to the first embodiment. During the second swing, the control device 160 raises the boom 131 so that the clam bucket 133 does not come into contact with the loading target T. For this reason, the overall actuation time of the boom 131 becomes longer than that in the case in which the work equipment 130 is not activated until the swing angle reaches the second interference avoidance angle $\theta_2$. That is, the overall actuation time of the boom 131 is a time obtained by adding, to the time required for the downward actuation amount $\lambda_1$, the time required for the upward actuation amount $\delta_1$ until the second interference avoidance angle $\theta_2$ is reached and the time required for the downward actuation amount $\delta_1$ to cancel out the upward actuation amount $\delta_1$. If the actuation velocity of the boom 131 is represented by $v_1$, the overall actuation time of the boom 131 is approximately $(\lambda_1+2\delta_1)/v_1$. At this time, as illustrated in FIG. 7, if the overall actuation time $(\lambda_1+2\delta_1)/v_1$ of the boom 131 is equal to or less than the actuation time $\lambda_2/v_2$ of the stick 132 and the actuation time $\lambda_3/v_3$ of the clam bucket 133, the actuation time of the work equipment 130 as a whole is shorter than that in the case in which the work equipment 130 is not activated until the swing angle reaches the second interference avoidance angle $\theta_2$. In this case, $v_2$ represents the actuation velocity of the stick 132 and $v_3$ represents the actuation velocity of the clam bucket 133. That is, the control device 160, by initiating the actuation of the stick 132 and the clam bucket 133 while above the loading target T, can shorten the actuation time of the work equipment 130 as a whole relative to the case in which the work equipment 130 is not activated until the swing angle reaches the second interference avoidance angle $\theta_2$. FIG. 7 indicates the operation examples indicated below regarding the first embodiment.

Ex1A: Example of Raising the Boom 131, then Lowering the Stick 132 and the Clam Bucket 133

When automated control is initiated, the control device 160 initiates swinging of the swinging body 120. Next, the control device 160 initiates upward actuation of the boom cylinder 131C. When the boom 131 is raised by the upward actuation of the boom cylinder 131C, the lowest point on the clam bucket 133 rises in conjunction therewith.

Next, the control device 160 initiates downward actuation of the stick cylinder 132C and the bucket cylinder 133C, as well as closing actuation of the clam cylinder 1332C. The lowering of the height of the lowest point on the clam bucket 133 due to the downward actuation of the stick cylinder 132C and the bucket cylinder 133C is cancelled out by the raising of the height of the lowest point on the clam bucket 133 by the upward actuation of the boom cylinder 131C. Therefore, the height of the lowest point on the clam bucket 133 is maintained. The height of the lowest point on the clam bucket 133 is maintained at a position that is higher by the amount that the boom 131 has been raised from when the upward actuation of the boom cylinder 131C is initiated until the downward actuation of the stick 132 and the clam bucket 133 are initiated.

Thereafter, when the swing angle of the swinging body 120 reaches the second interference angle $\theta_2$, the control device 160 initiates downward actuation of the boom cylinder 131C. Due to the downward actuation of the boom cylinder 131C, the lowest point on the clam bucket 133 is lowered. However, by this time, the swing angle has already reached the second interference angle $\theta_2$. Therefore, the clam bucket 133 does not come into contact with the loading target T.

In Ex1A, the control device 160 initiates the downward actuation of the stick cylinder 132C and the bucket cylinder 133C simultaneously. However, there is no limitation thereto, and there may be a difference between the downward actuation initiation timing of the stick cylinder 132C and the downward actuation initiation timing of the bucket cylinder 133C. In Ex1A, the control device 160 initiates closing actuation of the clam cylinder 1332C and other actuation of the work equipment 130 simultaneously. However, there is no limitation thereto, and the initiation timing of the closing actuation of the clam cylinder 1332C may be any timing as long as the closing of the clam bucket 133 is completed during the automated control.

Ex1B: Example of Raising the Boom 131 Simultaneously with Initiating Lowering of the Stick 132 and the Clam Bucket 133

When automated control is initiated, the control device 160 initiates swinging of the swinging body 120. Next, the control device 160 initiates output of signals of upward actuation of the boom cylinder 131C, downward actuation of the stick cylinder 132C and the bucket cylinder 133C, and closing actuation signals of the clam cylinder 1332C. The lowering of the height of the lowest point on the clam bucket 133 due to the downward actuation of the stick cylinder 132C and the bucket cylinder 133C is cancelled out by the raising of the height of the lowest point on the clam bucket 133 by the upward actuation of the boom cylinder 131C. Therefore, the height of the lowest point on the clam bucket 133 is maintained at the height at the time the output of the actuation signals of the work equipment 130 was initiated.

Thereafter, when the swing angle of the swinging body 120 reaches the second interference angle $\theta_2$, the control device 160 initiates downward actuation of the boom cylinder 131C. Due to the downward actuation of the boom cylinder 131C, the lowest point on the clam bucket 133 is lowered. However, by this time, the swing angle has already reached the second interference angle $\theta_2$. Therefore, the clam bucket 133 does not come into contact with the loading target T.

In Ex1B, the control device 160 initiates the downward actuation of the stick cylinder 132C and the bucket cylinder 133C simultaneously. However, there is no limitation thereto, and there may be a difference between the downward actuation initiation timing of the stick cylinder 132C and the downward actuation initiation timing of the bucket cylinder 133C. However, the downward actuation initiation timing of the stick cylinder 132C and the downward actuation initiation timing of the bucket cylinder 133C both occur simultaneously with or later than the downward actuation initiation timing of the boom cylinder 131C. In Ex1B, the control device 160 initiates closing actuation of the clam cylinder 1332C and other actuation of the work equipment 130 simultaneously. However, there is no limitation thereto, and the initiation timing of the closing actuation of the clam cylinder 1332C may be any timing as long as the closing of the clam bucket 133 is completed during the automated control.

Ex1C: Example of Creating a Gap Between the Clam Bucket 133 and the Loading Target T by Raising the Stick 132 in Addition to the Boom 131

When automated control is initiated, the control device 160 initiates swinging of the swinging body 120. Next, the control device 160 initiates upward actuation of the boom cylinder 131C and the stick cylinder 132C. When the boom 131 and the stick 132 are raised by the upward actuation actions of the boom cylinder 131C and the stick cylinder 132, the lowest point on the clam bucket 133 also rises in conjunction therewith.

Next, the control device 160 initiates downward actuation of the bucket cylinder 133C. Additionally, when the upward actuation amount of the stick cylinder 132C becomes $\delta_2$, the control device 160 initiates downward actuation of the stick cylinder 132C.

The lowering of the height of the lowest point on the clam bucket 133 due to the downward actuation of the stick cylinder 132C and the bucket cylinder 133C is cancelled out by the raising of the height of the lowest point on the clam bucket 133 by the upward actuation of the boom cylinder 131C. Therefore, the height of the lowest point on the clam bucket 133 is maintained. The height of the lowest point on the clam bucket 133 is maintained at a position that is higher by the amount that the boom 131 has been raised from when the upward actuation of the boom cylinder 131C and the stick cylinder 132C is initiated until the downward actuation of the stick 132 is initiated.

Thereafter, when the swing angle of the swinging body 120 reaches the second interference angle $\theta_2$, the control device 160 initiates downward actuation of the boom cylinder 131C and closing actuation of the clam cylinder 1332C. Due to the downward actuation of the boom cylinder 131C, the lowest point on the clam bucket 133 is lowered. However, by this time, the swing angle has already reached the second interference angle $\theta_2$. Therefore, the clam bucket 133 does not come into contact with the loading target T.

In Ex1C, the control device 160 initiates the upward actuation of the boom cylinder 131C and the stick cylinder 132C simultaneously. However, there is no limitation thereto, and there may be a difference between the upward actuation initiation timing of the boom cylinder 131C and the upward actuation initiation timing of the stick cylinder 132C. In Ex1C, the control device 160 initiates the closing actuation of the clam cylinder 1332C when the swing angle has reached the second interference angle $\theta_2$. However, there is no limitation thereto, and the initiation timing of the closing actuation of the clam cylinder 1332C may be any timing as long as the closing of the clam bucket 133 is completed during the automated control.

Ex1D: Example of Creating a Gap Between the Clam Bucket 133 and the Loading Target T by Raising the Boom 131 after Raising the Stick 132

When automated control is initiated, the control device 160 initiates swinging of the swinging body 120. Next, the control device 160 initiates upward actuation of the stick cylinder 132C. When the stick 132 is raised by the upward actuation operation of the stick cylinder 132C, the lowest point on the clam bucket 133 also rises in conjunction therewith.

Next, the control device 160 initiates output of upward actuation signals of the boom cylinder 131C and downward actuation signals of the bucket cylinder 133C. Additionally, when the upward actuation amount of the stick cylinder 132C becomes $\delta_2$, the control device 160 initiates output of downward actuation signals of the stick cylinder 132C and the bucket cylinder 133C. The lowering of the height of the lowest point on the clam bucket 133 due to the downward actuation of the bucket cylinder 133C is cancelled out by the raising of the height of the lowest point on the clam bucket 133 by the upward actuation of the boom cylinder 131C. Therefore, the height of the lowest point on the clam bucket 133 is maintained. The height of the lowest point on the clam bucket 133 is maintained at a position that is higher by the amount that the stick 132 has been raised from when the upward actuation of the stick cylinder 132C is initiated until the downward actuation of the clam bucket 133 is initiated.

Thereafter, when the swing angle of the swinging body 120 reaches the second interference angle $\theta_2$, the control device 160 initiates downward actuation of the boom cylinder 131C. Due to the downward actuation of the boom cylinder 131C, the lowest point on the clam bucket 133 is lowered. However, by this time, the swing angle has already reached the second interference angle $\theta_2$. Therefore, the clam bucket 133 does not come into contact with the loading target T.

In Ex1D, the control device 160 initiates the closing actuation of the clam cylinder 1332C when the swing angle has reached the second interference angle $\theta_2$. However, there is no limitation thereto, and the initiation timing of the closing actuation of the clam cylinder 1332C may be any timing as long as the closing of the clam bucket 133 is completed during the automated control.

Ex1E: Example of Creating a Gap Between the Clam Bucket 133 and the Loading Target T by Raising the Boom 131 and the Clam Bucket 133

When automated control is initiated, the control device 160 initiates swinging of the swinging body 120. Next, the control device 160 initiates upward actuation of the boom cylinder 131C and the bucket cylinder 133C. The upward actuation operation of the boom cylinder 131C and the bucket cylinder 133C raises the boom 131 and the clam bucket 133.

When the upward actuation amount of the bucket cylinder 133C becomes $\delta_3$, the control device 160 initiates downward actuation of the stick cylinder 132C and the bucket cylinder 133C. The lowering of the height of the lowest point on the clam bucket 133 due to the downward actuation of the stick cylinder 132C and the bucket cylinder 133C is cancelled out by the raising of the height of the lowest point on the clam bucket 133 by the upward actuation of the boom cylinder 131C. Therefore, the height of the lowest point on the clam bucket 133 is maintained. The height of the lowest point on the clam bucket 133 is maintained at a position that is higher by the amount that the clam bucket 133 has been raised by the upward actuation of the boom cylinder 131C and the bucket cylinder 133C.

Thereafter, when the swing angle of the swinging body 120 reaches the second interference angle $\theta_2$, the control device 160 initiates downward actuation of the boom cylinder 131. Due to the downward actuation of the boom cylinder 131C, the lowest point on the clam bucket 133 is lowered. However, by this time, the swing angle has already reached the second interference angle $\theta_2$. Therefore, the clam bucket 133 does not come into contact with the loading target T. In Ex1E, the control device 160 initiates the upward actuation of the boom cylinder 131C and the bucket cylinder 133C simultaneously. However, there is no limitation thereto, and there may be a difference between the upward actuation initiation timing of the boom cylinder 131 and the upward actuation initiation timing of the bucket cylinder 133C. In Ex1E, the control device 160 initiates the closing actuation of the clam cylinder 1332C when the swing angle has reached the second interference angle $\theta_2$. However, there is no limitation thereto, and the initiation timing of the closing actuation of the clam cylinder 1332C may be any timing as long as the closing of the clam bucket 133 is completed during the automated control.

Ex1F: Example of Creating a Gap Between the Clam Bucket 133 and the Loading Target T by Raising the Boom 131 after Raising the Clam Bucket 133

When automated control is initiated, the control device 160 initiates swinging of the swinging body 120. Next, the control device 160 initiates upward actuation of the bucket cylinder 133C. The clam bucket 133 is raised by the upward actuation operation of the bucket cylinder 133C.

Next, the control device 160 initiates upward actuation of the boom cylinder 131C. When the upward actuation amount of the bucket cylinder becomes $\delta_3$, the control device 160 initiates downward actuation of the stick cylinder 132C and the bucket cylinder 133C. The lowering of the height of the lowest point on the clam bucket 133 due to the downward actuation of the bucket cylinder 133C is cancelled out by the raising of the height of the lowest point on the clam bucket 133 by the upward actuation of the boom cylinder 131C. Therefore, the height of the lowest point on the clam bucket 133 is maintained. The height of the lowest point on the clam bucket 133 is maintained at a position that is higher by the amount that the clam bucket 133 has been raised by the upward actuation of the boom cylinder 131C and the bucket cylinder 133C.

Thereafter, when the swing angle of the swinging body 120 reaches the second interference angle $\theta_2$, the control device 160 initiates downward actuation of the boom cylinder 131C. Due to the downward actuation of the boom cylinder 131C, the lowest point on the clam bucket 133 is lowered. However, by this time, the swing angle has already reached the second interference angle $\theta_2$. Therefore, the clam bucket 133 does not come into contact with the loading target T.

In Ex1F, the control device 160 initiates the closing actuation of the clam cylinder 1332C when the swing angle has reached the second interference angle $\theta_2$. However, there is no limitation thereto, and the initiation timing of the closing actuation of the clam cylinder 1332C may be any timing as long as the closing of the clam bucket 133 is completed during the automated control.

In all of the examples Ex1A to Ex1F above, the actuation time of the work equipment 130 as a whole is shortened in comparison with examples in which the work equipment 130 is not activated until the swing angle reaches the second interference avoidance angle $\theta_2$. In the examples illustrated in FIG. 7, an initiation of the swinging operation precedes the work equipment operations. However, the swinging operation may be initiated simultaneously with the work equipment operations or later than the work equipment operations.

«Operations of the Control Device 160»

Figure 8:
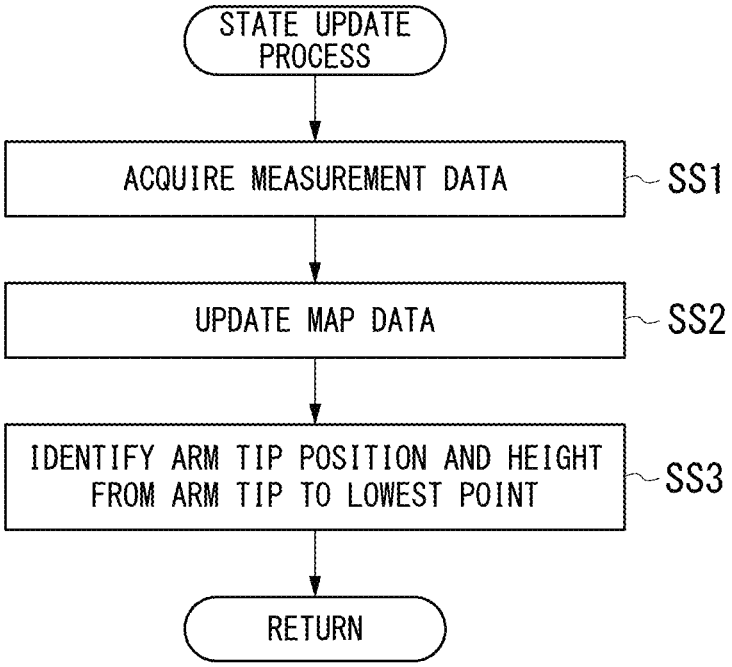
FIG. 8 A flow chart indicating some of the actions of the control device according to the first embodiment.

FIG. 8 is a flow chart illustrating some of the operations of the control device 160 according to the first embodiment. In this case, an example in which the control device 160 raises the boom 131, then lowers the stick 132 and the clam bucket 133, as indicated in Ex1A in FIG. 7, will be explained. For the other examples, such as Ex1B to Ex1G, also, the control device 160 can implement control by similar procedures, though with differences in the parts of the work equipment 130 that are activated before reaching the second interference angle $\theta_2$.

The control device 160 in the loading machine 100, while operating, performs the state update process indicated in FIG. 8 in each fixed control period.

The measurement data acquisition unit 611 acquires measurement data from the position/orientation calculator 151, the inclination measurer 152, the boom angle sensor 153, the stick angle sensor 154, the bucket angle sensor 155, and the detection device 156 (step SS1). The map generation unit 612 uses the measurement data acquired from the detection device 156 to update map data recorded in the main memory 630 (step SS2). As a result thereof, the control device 160 can constantly keep the map data representing the situation in the vicinity of the loading machine 100 in the newest state, and can make the newest position of the loading target T appear in the map data.

The work equipment position identification unit 614 identifies the position P at the tip of the stick 132 and the height H from the tip of the stick 132 to the lowest point on the clam bucket 133 in a vehicle body coordinate system with reference to the swinging body 120 based on the measurement data acquired in step SS1 (step SS3). As a result thereof, the control device 160 can constantly identify the current posture of the work equipment 130.

Figure 9:
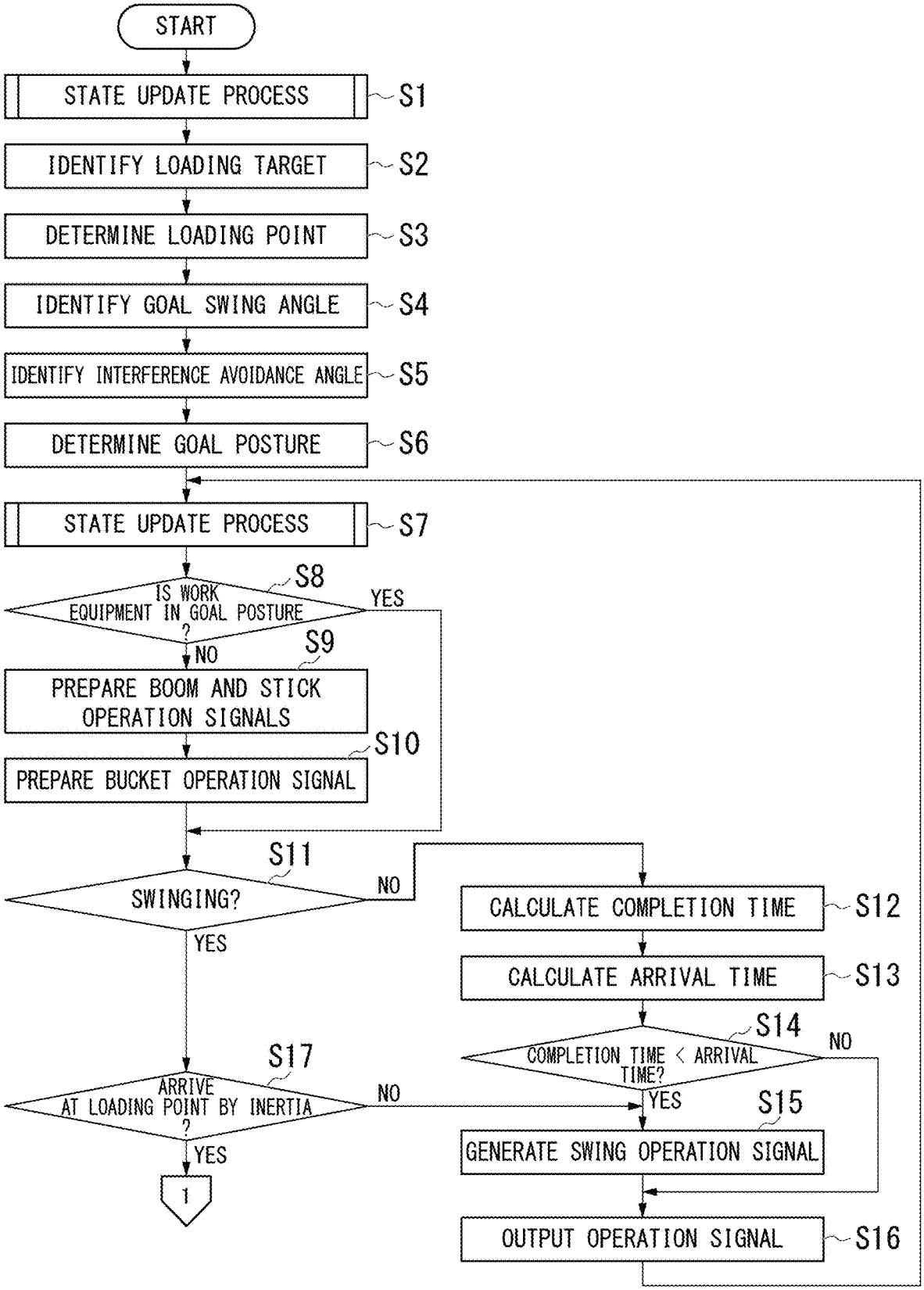
FIG. 9 A flow chart (part 1) indicating swing control in the control device according to the first embodiment.
Figure 10:
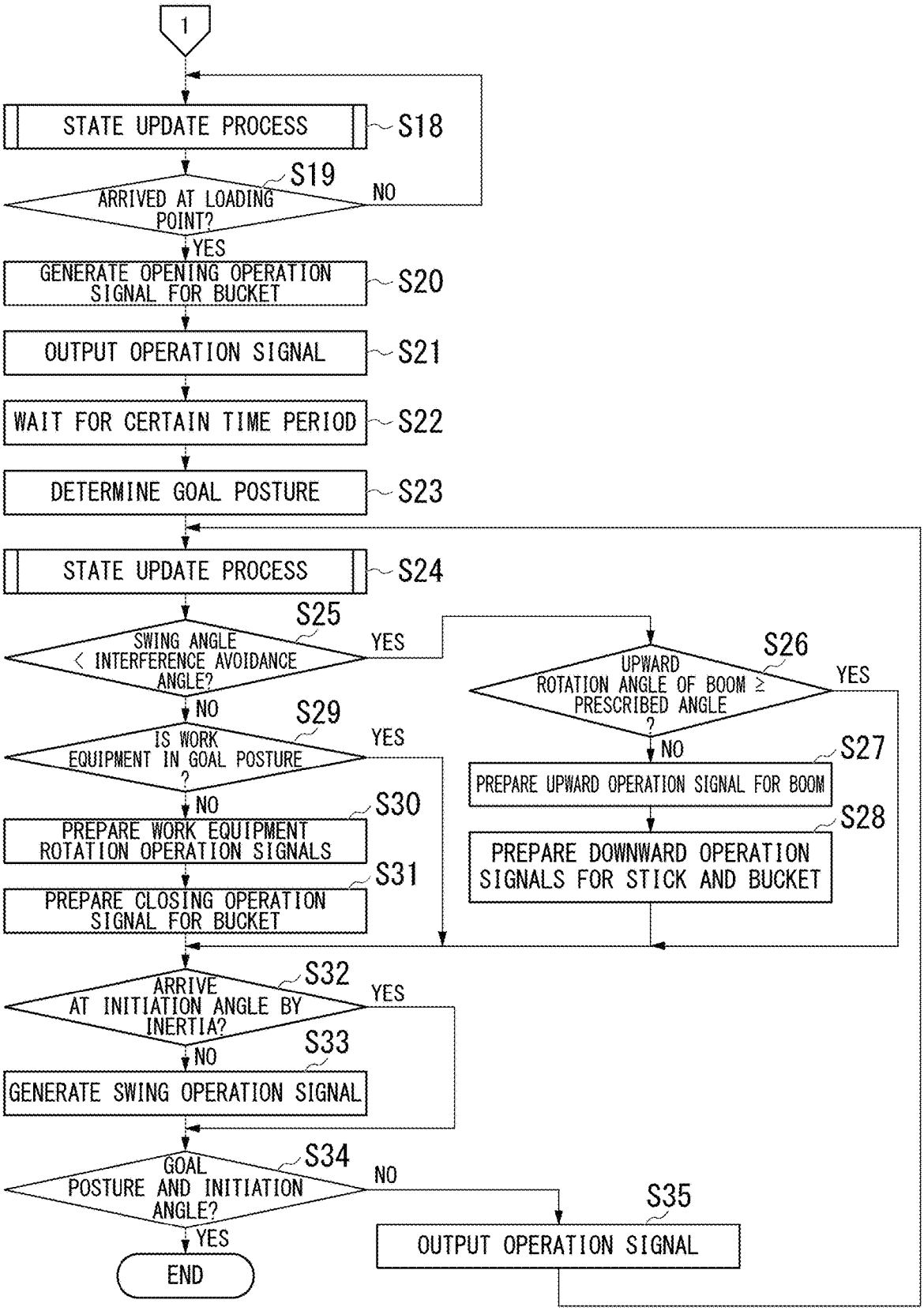
FIG. 10 A flow chart (part 2) indicating swing control in the control device according to the first embodiment.

FIG. 9 is a flow chart (part 1) indicating swing control by the control device 160 according to the first embodiment. FIG. 10 is a flow chart (part 2) indicating swing control by the control device 160 according to the first embodiment.

When the starting switch 143SW is depressed by the operator, the operation signal input unit 613 of the control device 160 receives an input of an automated control instruction signal. The control device 160 initiates automated control from step SS1 in FIG. 8, with the automated control signal as a trigger.

The control device 160 updates the measurement data, the map data, and the posture of the work equipment 130 to the newest state by means of the state update process indicated in FIG. 8 (step S1). The loading target identification unit 615 identifies the position and the shape of the loading target T based on the map data updated in step S1 (step S2). The loading target identification unit 615 determines a loading point based on the position of the loading target T identified in step S2 and the height H from the tip of the stick 132 to the lowest point on the clam bucket 133 identified in step S1 (step S3).

The swing angle identification unit 616 identifies a goal swing angle $\theta_0$ based on the position of the loading point in the map data determined in step S3 (step S4). Since the map data is indicated in the vehicle body coordinate system, the swing angle identification unit 616 identifies as the goal swing angle $\theta_0$, for example, the angle of the position vector of the loading point relative to the coordinate axis extending forward from the swinging body 120. The avoidance angle identification unit 617 identifies a first interference avoidance angle $\theta_1$ and a second interference avoidance angle $\theta_2$ based on the position and shape of the loading target T identified in step S2 (step S5). The goal posture determination unit 618 determines, as the goal posture, the posture of the boom 131 and the stick 132 when the tip of the stick 132 is positioned at the loading point (step S6).

Next, the control device 160 updates the measurement data, the map data, and the posture of the work equipment 130 to the newest state by means of the state update process indicated in FIG. 8 (step S7). Next, the movement control unit 619 determines whether or not the posture of the work equipment 130 identified in step S7 approximates the goal posture determined in step S6 (step S8). For example, the movement control unit 619 determines that the posture of the work equipment 130 approximates the goal posture in the case in which the difference between the position of the tip of the stick 132 in the goal posture and the current position of the tip of the stick 132 is a prescribed value or less.

If the posture of the work equipment 130 does not approximate the goal posture (step S8: NO), the movement control unit 619 generates an operation signal to bring the boom 131 and the stick 132 closer to the goal posture (step S9). At this time, the movement control unit 619 generates the operation signal based on the position and velocity of the boom 131 and the stick 132 identified in step S7.

Additionally, the movement control unit 619 calculates the sum of the actuation velocities of the boom 131 and the stick 132 based on the generated operation signals of the boom 131 and the stick 132, and generates operation signals for actuating the clam bucket 133 at the same velocity as the sum of the actuation velocities (step S10). As a result thereof, the movement control unit 619 can generate operation signals for holding the angle of the clam bucket 133 with respect to the ground.

The movement control unit 619 determines whether or not the work equipment 130 is swinging (step S11). The movement control unit 619 determines that the work equipment 130 is swinging, for example, when the swing velocity of the swinging body 120 is a prescribed velocity or higher. If the work equipment 130 is not swinging (step S11: NO), the movement control unit 619 calculates, based on the velocities of the boom 131 and the stick 132 identified in step S7, the completion time required for the work equipment 130 to arrive at the goal posture (step S12). Additionally, if the swinging body 120 has initiated swinging, the movement control unit 619 calculates the arrival time required for the swing angle to arrive at the first interference avoidance angle $\theta_1$ identified in step S5 (step S13). The movement control unit 619 determines whether or not the completion time calculated in step S12 is less than the arrival time calculated in step S13 (step S14). In other words, the movement control unit 619 determines whether or not the work equipment 130 will be in the goal posture by the time the swing angle arrives at the first interference avoidance angle $\theta_1$.

If the completion time is equal to or greater than the arrival time (step S14: NO), i.e., if the work equipment 130 will not be in the goal posture by the time the swing angle arrives at the first interference avoidance angle $\theta_1$, the movement control unit 619 does not generate a swing operation signal for the swinging body 120. On the other hand, if the completion time is less than the arrival time (step S14: YES), i.e., the work equipment 130 will be in the goal posture by the time the swing angle arrives at the first interference avoidance angle $\theta_1$, the movement control unit 619 generates a swing operation signal for the swinging body 120 (step S15). As a result thereof, the control device 160 can prevent the work equipment 130 from coming into contact with the loading target T.

Then, the operation signal output unit 621 outputs, to the control valve 123, operation signals generated in at least one of steps S9, S10, and S15 (step S16). As a result thereof, the loading machine 100 is actuated. Then, the control device 160 returns the process to step S7 and continues control.

On the other hand, if it is determined that the work equipment 130 is swinging in step S11 (step S11: YES), the movement control unit 619 determines, based on the swing velocity of the work equipment 130 identified in step S7, whether or not the tip of the stick 132 will reach the loading point by swinging by inertia if the swing operation signal is stopped (step S17). If the tip of the stick 132 will not reach the loading point by swinging by inertia (step S17: NO), the movement control unit 619 generates a swing operation signal in step S15 and the operation signal output unit 621 outputs a swing operation signal to the control valve 123 in step S16.

On the other hand, if it is determined that the tip of the stick 132 will reach the loading point by swinging by inertia (step S17: YES), the control device 160 updates the measurement data, the map data, and the posture of the work equipment 130 to the newest state by the state update process indicated in FIG. 8 (step S18 in FIG. 10). The movement control unit 619 determines, based on the map data updated in step S18, whether or not the tip of the stick 132 has arrived at the loading point (step S19). If the tip of the stick 132 has not reached the loading point (step S19: NO), the control device 160 returns the process to step S18 and waits until the loading point is reached.

If the tip of the stick 132 has reached near the loading point (step S19: YES), the clam control unit 620 generates an opening operation signal for the clam bucket 133 (step S20). The clam control unit 620 may open the clam bucket 133 before reaching the loading point, or may open the clam bucket 133 after having arrived at the loading point. The operation signal output unit 621 outputs the opening operation signal generated in step S20 to the control valve 123 (step S21). The clam control unit 620 waits until a certain time period has elapsed after the opening operation signal for the clam bucket 133 was output (step S22). This time period is the time period until a certain amount of earth and sand drops from an open clam bucket 133. This time period may be shorter than the time period until all of the earth and sand drops from the clam bucket 133.

After the certain time period, the control device 160 initiates control associated with the second swing. The goal posture determination unit 618 determines the goal posture of the work equipment 130 in the second swing by reading out, from the storage unit 650, a predetermined excavation initiation posture of the work equipment 130 (step S23).

Next, the control device 160 updates the measurement data, the map data, and the posture of the work equipment 130 by means of the state update process indicated in FIG. 8 (step S24). Next, the movement control unit 619 determines whether or not the swing angle of the swinging body 120 from the time earth and sand discharge is initiated until the current time is less than the second interference avoidance angle $\theta_2$ (step S25). If the swing angle is less than the second interference avoidance angle $\theta_2$ (step S25: YES), the movement control unit 619 determines whether or not the rotation angle for upward operation of the boom 131 from when the second swing is initiated has reached the prescribed angle (step S26).

If the rotation angle for upward operation of the boom 131 is less than the prescribed angle (step S26: NO), the movement control unit 619 generates an upward operation signal of the boom 131 (step S27). The upward operation signal of the boom 131 by step S27 may be generated after the swinging of the swinging body 120 has started. For example, the upward operation signal of the boom 131 may be generated after a certain period of time from the start of the second swing. On the other hand, the upward operation signal of the boom 131 may be generated before the swinging body 120 starts swinging. For example, the upward operation signal of the boom 131 may be generated a certain time period before the second swing starts.

Next, the movement control unit 619 generates downward operation signals for the stick 132 and the clam bucket 133 (step S28). The downward operation signals are operation signals for implementing control so that the raising amount of the boom 131 by the upward operation signal for the boom 131 generated in step S27 becomes equal to the sum of the lowering amounts of the stick 132 and the clam bucket 133. The downward operation signals for the stick 132 and the clam bucket 133 in step S28 may be generated after the swinging body 120 has started swinging. On the other hand, the downward operation signals of the stick 132 and the clam bucket 133 may be generated before the swinging body 120 starts swinging. For example, the downward operation of the stick 132 and the clam bucket 133 may be initiated after a certain time period from the initiation of the upward operation of the boom 131. Alternatively, the downward operation of the stick 132 and the clam bucket 133 may be initiated simultaneously with the initiation of the upward operation of the boom 131. On the other hand, the downward operation signals of the stick 132 and the clam bucket 133 are not generated before the upward operation of the boom 131. This is because, if the downward operation of the stick 132 or the clam bucket 133 occurs before the boom 131 or the clam bucket 133 is raised, the lowest point on the clam bucket 133 will be lowered, and there is a possibility that the work equipment 130 and the loading target T will come into contact. Alternatively, if the lowering operation of the stick 132 or the clam bucket 133 is performed in a state in which there is no gap between the clam bucket 133 and the loading target T, the lowest point on the clam bucket 133 will be lowered, and there is a possibility that the work equipment 130 and the loading target T will come into contact. If upward operation of the boom 131 is performed before the swinging body 120 starts swinging, the downward operation of the stick 132 and the clam bucket 133 may be performed before the swinging body 120 starts swinging.

The upward operation amount $\delta_1$ of the boom 131 and the downward operation amount of the stick 132 and the clam bucket 133 before the second interference avoidance angle $\theta_2$ is reached may be defined in advance. Since the tolerable maximum value of the upward operation amount $\delta_1$ of the boom 131 changes depending on the size and position of the loading target T, it may be calculated by using a function for determining operation amounts from the size and position of the loading target T pre-recorded in the storage unit 650, etc. The size and position of the loading target T may also be input by the operator. The larger the loading target T is, the higher the height of the loading point becomes, and therefore, the downward actuation amount $\lambda_1$ of the boom 131 is increased. For this reason, the larger the loading target T is, the smaller the tolerable maximum value of the upward operation amount $\delta_1$ of the boom 131 becomes. Additionally, the closer the loading target T is to the swinging body 120, the closer the loading point is to the swinging body, and therefore, the downward actuation amount $\lambda_1$ of the boom 131 increases while the downward actuation amount $\lambda_2$ of the stick 132 and the downward actuation amount $\lambda_3$ of the clam bucket 133 decrease. For this reason, the tolerable maximum value of the raising amount of the boom 131 becomes smaller as the loading target T becomes closer.

On the other hand, if the rotation angle for the upward operation of the boom 131 in step S26 has reached the prescribed angle (step S26: YES), the movement control unit 619 generates an operation signal (neutral signal) for maintaining the posture of the work equipment 130.

If the swing angle is equal to or greater than the second interference avoidance angle $\theta_2$ in step S25 (step S25: NO), the movement control unit 619 determines whether or not the posture of the work equipment 130 identified in step S24 approximates the goal posture determined in step S23 (step S29). If the posture of the work equipment 130 does not approximate the goal posture (step S29: NO), the movement control unit 619 generates operation signals for bringing the boom 131, the stick 132, and the clam bucket 133 closer to the goal posture (step S30). Additionally, the clam control unit 620 generates a closing operation signal for the clam bucket 133 (step S31). If the posture of the work equipment 130 approximates the goal posture (step S29: YES), the movement control unit 619 generates a neutral signal for maintaining the posture of the work equipment 130.

Additionally, the movement control unit 619 determines, based on the swing velocity of the work equipment 130 identified in step S24, whether or not the goal swing angle $\theta_0$ identified in step S4 can be reached by swinging by inertia if the swing operation signal is stopped (step S32). If the goal swing angle $\theta_0$ cannot be reached by swinging by inertia (step S32: NO), the movement control unit 619 generates a swing operation signal (step S33). On the other hand, if the goal swing angle $\theta_0$ can be reached by swinging by inertia (step S32: YES), the movement control unit 619 does not generate a swing operation signal.

Next, the operation signal output unit 621 determines whether or not the work equipment 130 approximates the goal posture and the swing angle of the swinging body 120 has reached the goal swing angle $\theta_0$ (step S34). In the case in which the work equipment 130 does not approximate the goal posture or the swing angle of the swinging body 120 is less than the goal swing angle $\theta_0$ (step S34: NO), the operation signal output unit 621 outputs, to the control valve 123, the control signals for the work equipment 130 generated in step S27 and step S28, or in step S30 and step S31, or a neutral signal for the work equipment 130 and the operation signals for the swinging body 120 generated in step S30 (step S35). Then, the control device 160 returns the process to step S24 and continues control.

On the other hand, if the work equipment 130 approximates the goal posture and the swing angle of the swinging body 120 has reached the goal swing angle $\theta_0$ (step S34: YES), the control device 160 ends the automated control.

Functions/Effects

In this way, if the swing angle is less than the second interference avoidance angle $\theta_2$ during the second swing in automated control, i.e., if the clam bucket 133 is positioned above the loading target T, the control device 160 according to the first embodiment outputs operation signals for actuating the boom 131 (first link component) upward and outputs operation signals for actuating the stick 132 and the clam bucket 133 (second link component) downward. As a result thereof, the control device 160 can reduce the downward operation amounts of the stick 132 and the clam bucket 133 after the swing angle has exceeded the second interference avoidance angle $\theta_2$, thereby shortening the time period required for the second swing.

Second Embodiment

Figure 11:
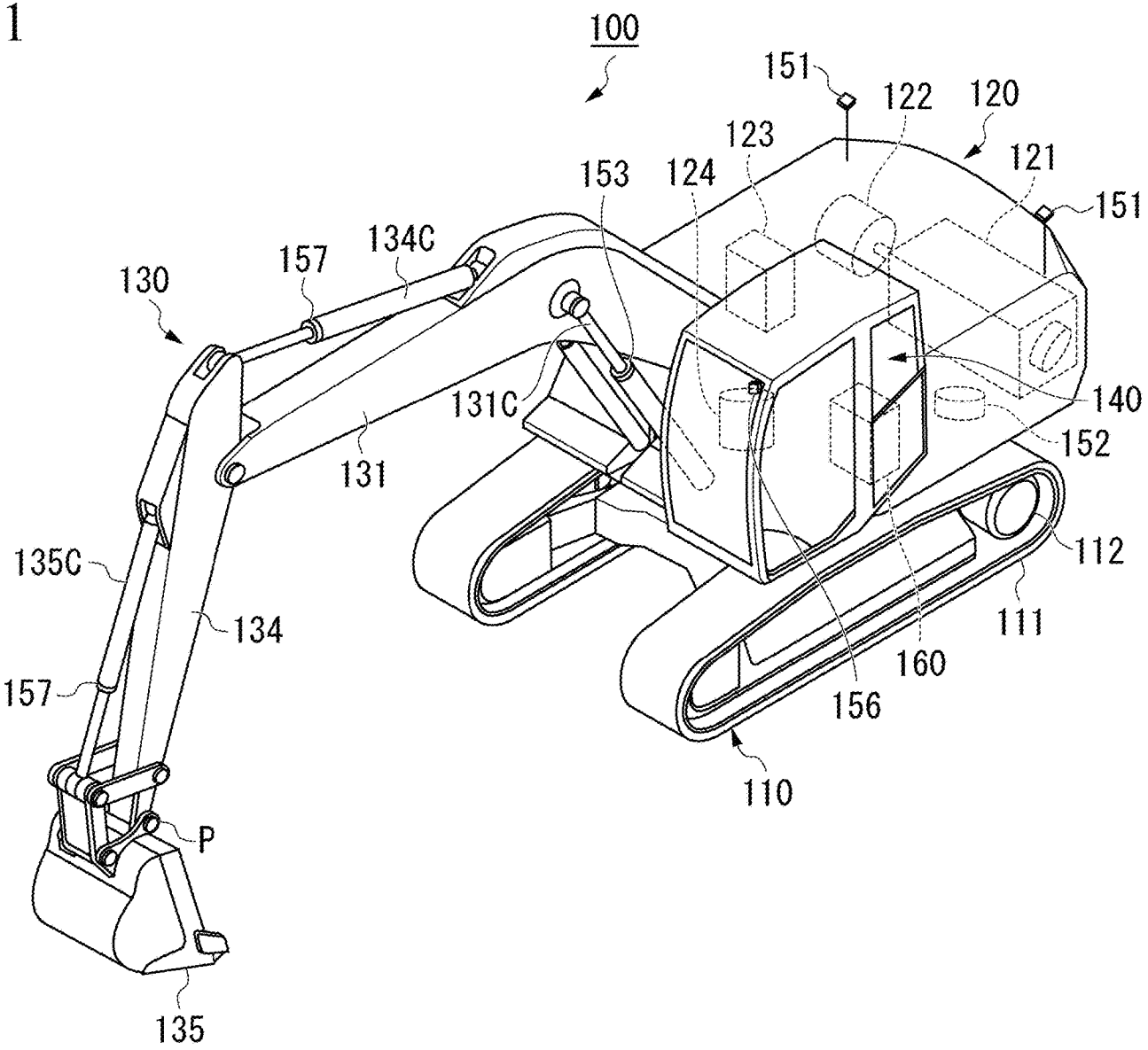
FIG. 11 A schematic diagram illustrating the structure of a loading machine according to a second embodiment.

FIG. 11 is a schematic diagram illustrating the structure of the loading machine 100 according to the second embodiment. The loading machine 100 according to the first embodiment is a face shovel. In contrast therewith, the loading machine 100 according to the second embodiment is a backhoe.

The loading machine 100 according to the second embodiment is provided with an arm 134 and a bucket 135 as the work tool instead of the stick 132 and the clam bucket 133 as the work tool in the first embodiment.

The arm 134 is connected to a boom 131 and the bucket 135. The proximal end of the arm 134 is rotatably attached to the distal end of the boom 131 by an arm pin.

The bucket 135 is rotatably attached to the distal end of the arm 134 by a pin. The bucket 135 functions as a container for accommodating excavated earth and sand. The bucket 135 is attached so that an opening faces towards the swinging body 120. That is, during excavation, the opening of the bucket 135 and the swinging body 120 face each other.

The boom 131, the arm 134, and the bucket 135 are an example of link components.

The arm 134 is actuated by an arm cylinder 134C, which is a hydraulic cylinder. The proximal end of the arm cylinder 134C is attached to the boom 131. The distal end of the arm cylinder 134C is attached to the arm 134.

The bucket 135 is actuated by a bucket cylinder 135C, which is a hydraulic cylinder. The proximal end of the bucket cylinder 135C is attached to the arm 134. The distal end of the bucket cylinder 135C is attached to the bucket 135.

The control device 160, in order to discharge the earth and sand, outputs a rotation operation signal in the dumping direction of the bucket 135 instead of the opening operation signal in the first embodiment. The control device 160 may output a swing operation signal for the swinging body 120 while the rotation operation signal in the dumping direction is being output in order to shorten the cycle time. The cycle time refers to the time period from the initiation of earth and sand excavation, the first swing, the loading of earth and sand, and the second swing, to the next excavation preparation posture.

Normally, the backhoe excavates earth and sand by pulling the bucket 135 in a direction towards the vehicle body. Therefore, at the time excavation is initiated, the bucket 135 is positioned at a position distanced from the swinging body 120. For this reason, the posture of the boom 131 and the arm 134 at the time excavation is initiated becomes a state in which the angle with respect to the ground is close to horizontal. The excavation preparation posture of the backhoe (goal posture of the second swing) is preferably a posture in which the bucket 135 is positioned near an excavation target, more preferably a posture in which the opening of the bucket 135 faces rearward with respect to the vehicle body, or a posture in which the opening of the bucket 135 faces the excavation target. Meanwhile, since the height of the bucket 135 is required to be raised higher than the loading target T at the time of loading, the boom 131 is required to be raised. For this reason, the downward actuation amount of the boom 131 when changing to the next excavation preparation posture after earth and sand discharge is normally greater than the downward actuation amount of the arm 134. Since the bucket cylinder 135C for actuating the bucket 135 is connected to the arm 134, the actuation amount of the bucket cylinder 135C is not large, unlike a face shovel.

Therefore, the control device 160 according to the second embodiment, during the second swing, outputs an upward operation signal of the arm 134 or the bucket 135 and outputs a downward operation signal of the boom 131 while the swing angle is smaller than the second interference avoidance angle $\theta_2$.

Figure 12:
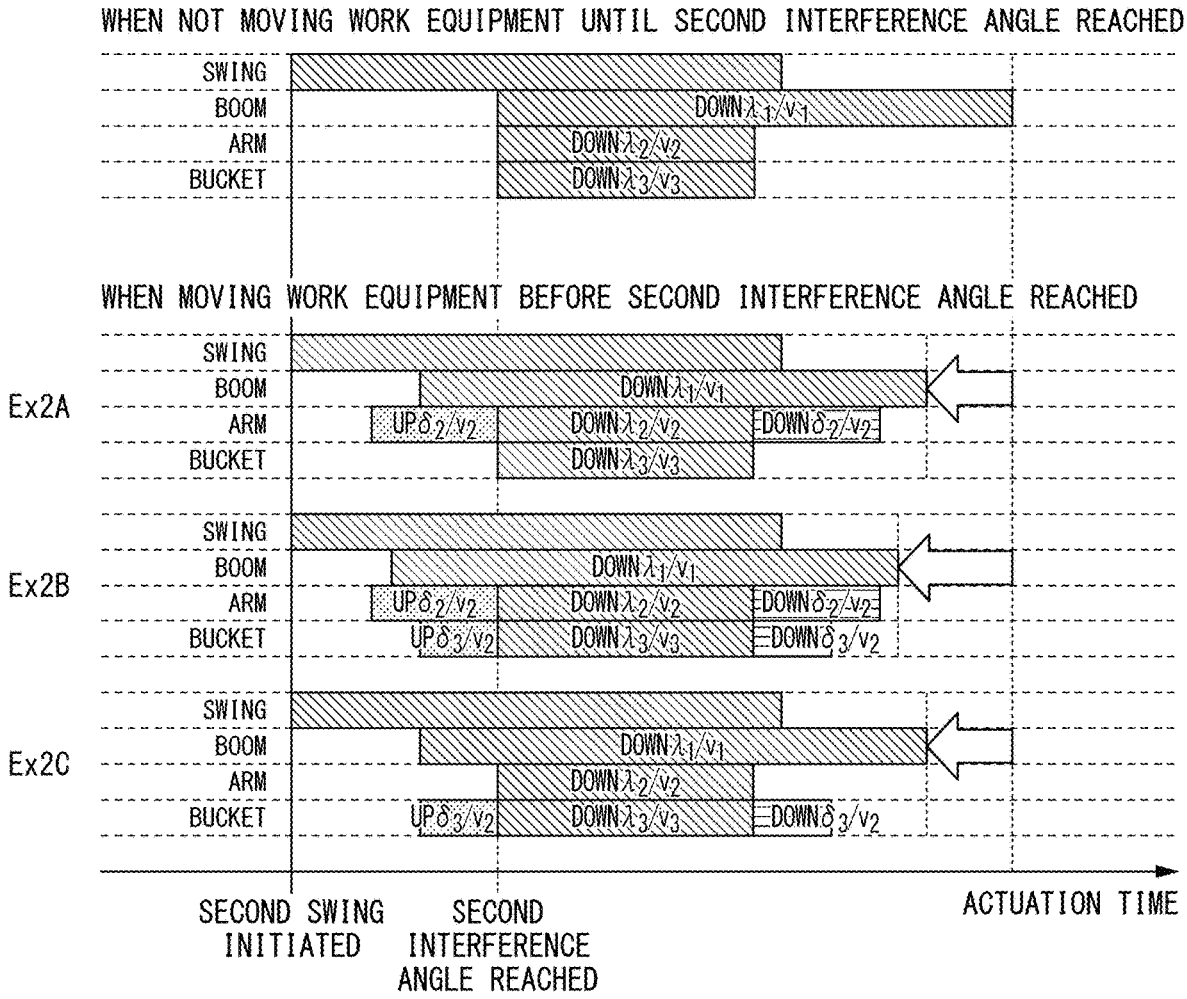
FIG. 12 A diagram indicating second swing time shortening effects according to the second embodiment.

FIG. 12 is a diagram indicating the second swing time shortening effects according to the second embodiment. During the second swing, the control device 160 raises the arm 134 or the bucket 135 so that the bucket 135 does not come into contact with the loading target T. For this reason, the overall actuation time of the arm 134 or the bucket 135 becomes longer than that in the case in which the work equipment 130 is not activated until the swing angle reaches the second interference avoidance angle $\theta_2$. That is, the overall actuation time of the arm 134 is a time obtained by adding, to the time required for operation by the downward actuation amount $\lambda_2$, the time required for operation by the upward actuation amount $\delta_2$ until the second interference avoidance angle $\theta_2$ is reached and the time required for operation by the downward actuation amount $\delta_2$ to cancel out the upward actuation amount $\delta_2$. That is, the overall actuation time of the arm 134 is approximately $(\lambda_2+2\delta_2)/v_2$. Additionally, the overall actuation time of the bucket 135 is a time obtained by adding, to the time required for operation by the downward actuation amount $\lambda_3$, the time required for operation by the upward actuation amount $\delta_3$ until the second interference avoidance angle $\theta_2$ is reached and the time required for operation by the downward actuation amount $\delta_3$ to cancel out the upward actuation amount $\delta_3$. That is, the overall actuation time of the bucket 135 is approximately $(\lambda_3+2\delta_3)/v_3$. At this time, as illustrated in FIG. 12, if the overall actuation time $(\lambda_2+2\delta_2)/v_2$ of the arm 134 or the overall actuation time $(\lambda_3+2\delta_3)/v_3$ of the bucket 135 is equal to or less than the rotation time $\lambda_1/v_1$ of the boom 131, the actuation time of the work equipment 130 as a whole is shorter than that in the case in which the work equipment 130 is not activated until the swing angle reaches the second interference avoidance angle $\theta_2$. That is, the control device 160, by initiating the actuation of the boom 131 above the loading target T, can shorten the actuation time of the work equipment 130 as a whole relative to the case in which the work equipment 130 is not activated until the swing angle reaches the second interference avoidance angle $\theta_2$.

FIG. 12 indicates the operation examples indicated below regarding the second embodiment.

Ex2A: Example of Raising the Arm 134, then Lowering the Boom 131 and the Bucket 135

When automated control is initiated, the control device 160 initiates swinging of the swinging body 120. Next, the control device 160 initiates upward actuation of the arm cylinder 134. When the arm 134 is raised by the upward actuation operation of the arm cylinder 134C, the lowest point on the bucket 135 also rises in conjunction therewith.

Next, the control device 160 initiates downward actuation of the boom cylinder 131C. The lowering of the height of the lowest point on the bucket 135 due to downward actuation of the boom cylinder 131C is cancelled out by the raising of the height of the lowest point on the bucket 135 by the upward actuation of the arm cylinder 134C. Therefore, the height of the lowest point on the bucket 135 is maintained. The height of the lowest point on the bucket 135 is maintained at a position that is higher by the amount that the arm 134 has been raised from when the upward actuation of the arm 134 is initiated until the downward actuation of the boom 131 is initiated.

Thereafter, when the swing angle of the swinging body 120 reaches the second interference angle $\theta_2$, the control device 160 initiates output of downward actuation signals of the arm cylinder 134C and the bucket cylinder 135C. Due to the downward actuation of the arm cylinder 134C and the bucket cylinder 135C, the lowest point on the bucket 135 is lowered. However, by this time, the swing angle has already reached the second interference angle $\theta_2$. Therefore, the bucket 135 does not come into contact with the loading target T.

In Ex2A, the control device 160 initiates the downward actuation of the boom cylinder 131C after the upward actuation of the arm cylinder 134C. However, there is no limitation thereto, and the upward actuation of the arm cylinder 134C and the downward actuation of the boom cylinder 131C may be performed simultaneously. In Ex2A, the control device 160 initiates downward actuation of the arm cylinder 134C and the bucket cylinder 135C simultaneously. However, there is no limitation thereto, and there may be a difference between the initiation timing of the downward actuation of the arm cylinder 134C and the initiation timing of the downward actuation of the bucket cylinder 135C. However, the initiation timing of the downward actuation of the arm cylinder 134C and the initiation timing of the downward actuation of the bucket cylinder 135C are both simultaneous with or later than the timing at which the swing angle of the swinging body 120 reaches the second interference angle $\theta_2$.

Ex2B: Example of Creating a Gap Between the Bucket 135 and the Loading Target T by Raising the Bucket 135 in Addition to the Arm 134

When automated control is initiated, the control device 160 initiates swinging of the swinging body 120. Next, the control device 160 initiates upward actuation of the arm cylinder 134C and the bucket cylinder 135C. The upward actuation operations on the arm cylinder 134C and the bucket cylinder 135C raise the arm 134 and the bucket 135, thereby raising the lowest point on the bucket 135.

Next, the control device 160 initiates output of downward actuation of the boom cylinder 131C. The lowering of the height of the lowest point on the bucket 135 due to downward actuation of the boom cylinder 131C is cancelled out by the raising of the height of the lowest point on the bucket 135 by the upward actuation of the arm cylinder 134C and the upward actuation of the bucket cylinder 135C. Therefore, the height of the lowest point on the bucket 135 is maintained. Since the control device 160 according to Ex2B can compensate for the downward actuation amount of the boom cylinder 131C by the upward actuation amounts of both the arm cylinder 134C and the bucket cylinder 135C, the actuation velocity $v_1$ of the boom cylinder 131C can be increased in comparison with Ex2A.

Thereafter, when the swing angle of the swinging body 120 reaches the second interference angle $\theta_2$, the control device 160 initiates downward actuation of the arm cylinder 134C and the bucket cylinder 135C. Due to the downward actuation of the arm cylinder 134C and the bucket cylinder 135C, the lowest point on the bucket 135 is lowered. However, by this time, the swing angle has already reached the second interference angle $\theta_2$. Therefore, the bucket 135 does not come into contact with the loading target T.

In Ex2B, the control device 160 initiates the downward actuation of the boom cylinder 131C after the upward actuation of the arm cylinder 134C, and further thereafter, initiates the upward actuation of the bucket cylinder 135C. However, there is no limitation thereto, and the upward actuation of the arm cylinder 134C and the downward actuation of the boom cylinder 131C may be performed simultaneously, and the upward actuation of the arm cylinder 134C and the upward actuation of the bucket cylinder 135C may be performed simultaneously.

Ex2C: Example of Creating a Gap Between the Bucket 135 and the Loading Target T by Raising the Bucket 135 without Raising the Arm 134

When automated control is initiated, the control device 160 initiates swinging of the swinging body 120. Next, the control device 160 initiates output of upward actuation signals of the bucket 135. The upward actuation operations on the bucket cylinder 135C raise the bucket 135.

Next, the control device 160 initiates output of downward actuation signals of the boom 131. The lowering of the height of the lowest point on the bucket 135 due to downward actuation of the boom cylinder 131C is cancelled out by the raising of the height of the lowest point on the bucket 135 by the upward actuation of the bucket cylinder 135C. Therefore, the height of the lowest point on the bucket 135 is maintained. The height of the lowest point on the bucket 135 is maintained at a position that is higher by the amount that the bucket 135 has been raised from when the upward actuation of the bucket 135 is initiated until the downward actuation of the boom 131 is initiated.

Thereafter, when the swing angle of the swinging body 120 reaches the second interference angle $\theta_2$, the control device 160 initiates output of downward actuation signals of the arm 134 and the bucket 135. Due to the downward actuation of the arm cylinder 134C and the bucket cylinder 135C, the lowest point on the bucket 135 is lowered. However, by this time, the swing angle has already reached the second interference angle $\theta_2$. Therefore, the bucket 135 does not come into contact with the loading target T.

In Ex2C, the control device 160 outputs downward actuation signals of the boom 131 and the bucket 135 simultaneously. However, there is no limitation thereto, and there may be a difference between the initiation timing for outputting the downward actuation signals of the boom 131 and the initiation timing for outputting the downward actuation signals of the bucket 135. However, the initiation timing for outputting the downward actuation signals of the arm 134 and the initiation timing for outputting the downward actuation signals of the bucket 135 are both at or later than the timing at which the swing angle of the swinging body 120 reaches the second interference angle Θ2.

In each of the above examples Ex2A to Ex2C, the actuation time of the work equipment 130 as a whole is shorter than that in the case in which the work equipment 130 is not activated until the swing angle reaches the second interference avoidance angle $\theta_2$.

Functions/Effects

In this way, if the swing angle is less than the second interference avoidance angle $\theta_2$ during the second swing in automated control, i.e., if the bucket 135 is positioned above the loading target T, the control device 160 according to the second embodiment outputs operation signals for actuating the arm 134 or the bucket 135 (first link component) upward and outputs operation signals for actuating the boom 131 (second link component) downward. As a result thereof, the control device 160 can reduce the downward operation amount of the boom 131 after the swing angle has exceeded the second interference avoidance angle $\theta_2$, thereby shortening the time period required for the second swing.

OTHER EMBODIMENTS

While embodiments have been explained in detailed with reference to the drawings above, the specific configurations are not limited to those mentioned above, and various design modifications, etc. are possible. That is, in another embodiment, the order of the above-described processes may be changed as appropriate. Additionally, some of the processes may be executed in parallel.

The control device 160 according to the above-described embodiment may be composed of a single computer, or the features of the control device 160 may be arranged so as to be distributed between multiple computers, so that the multiple computers cooperate with each other to function as the control device 160. At this time, some of the computers forming the control device 160 may be mounted in the loading machine 100 and the other computers may be provided outside the loading machine 100.

Although the goal postures according to the above-described embodiments were preset and recorded in the main memory 630 or the storage unit 650, there is no limitation thereto. For example, the loading machine 100 according to another embodiment may be configured so that the goal posture can be changed by operating the operating terminal 142. For example, in a loading machine 100 according to another embodiment, the goal posture may be changed by inputting, to the operating terminal 142, numerical values representing positions and angles of the boom 131, the stick 132 and the clam bucket 133, or the boom 131, the arm 134 and the bucket 135. Alternatively, in a loading machine 100 according to another embodiment, after the work equipment 130 has been controlled to have a preferable posture by operations by an operator, the operating terminal 142 may be operated so that the work equipment position identification unit 614 identifies the posture of the work equipment 130 and the goal posture is overwritten with said posture.

The control device 160 according to the above-described embodiments identifies the loading target on the basis of SLAM map data based on measurement data from the detection device 156. However, there is no limitation thereto. For example, the control device 160 according to another embodiment may receive inputs of the latitude and longitude and the orientation of the loading target, and may calculate the position and the shape of the loading target in the vehicle body coordinate system from the measurement results from the position/orientation calculator 151. Additionally, the control device 160 according to another embodiment may control the loading machine 100 based not on the vehicle body coordinate system, but rather on a global coordinate system represented by latitude, longitude, and altitude. In this case, the control device 160 may calculate angles such as the goal swing angle or the swing angle as angles with respect to a reference orientation in the global coordinate system.

The control device 160 according to the above-described embodiments calculates the angle of the swinging body 120 by integrating the angular velocity of the swinging body 120 measured by the inclination measurer 152. However, there is no limitation thereto. For example, the control device 160 according to another embodiment may calculate the angle of the swinging body 120 based on the difference between orientations measured by the position/orientation calculator 151. Additionally, in another embodiment, the angle of the swinging body 120 may be identified by using detection values from a rotation angle sensor provided on the swing motor 124.

The control device 160 according to the above-described embodiment performs automated control based on comparisons between the swing angle and the interference avoidance angle. However, there is no limitation thereto. For example, the control device 160 according to another embodiment may perform automated control based on comparisons between the position of the clam bucket 133 or the bucket 135 and the rearmost point $p_1$ (FIG. 4), on the external shape of the loading target T, in the swing direction of the swinging body 120. For example, the control device 160 according to another embodiment may adjust the swing initiation timing so that the clam bucket 133 or the bucket 135 is positioned in an area near the point $p_1$.

The loading machine 100 according to the above-described embodiments is directly operated by an operator boarding the driver's cab 140. However, there is no limitation thereto. For example, the loading machine 100 according to another embodiment may be operated by remote operation. That is, in another embodiment, operation signals may be transmitted to the control device 160 by communication from a remotely located operating device 143. Additionally, the control device 160 may be composed of a computer provided at a remote location, or may be composed of a control system in which the functions are distributed between computers provided respectively in the loading machine 100 and at the remote location.

The automated control according to the above-described embodiments moves the clam bucket 133 or the bucket 135 from a position at the time excavation has been completed to the loading point, and further to a position for initiating the next excavation. However, there is no limitation thereto. For example, in another embodiment, the clam bucket 133 or the bucket 135 may be moved from the position at which excavation was completed to the loading point and the earth and sand may be discharged by manual operations, and only the movement of the loading machine 100 from the loading point to the position for initiating the next excavation may be performed by automated control. In this case, after the clam bucket 133 or the bucket 135 has reached the loading point, the operator may operate a switch provided on an operation lever, etc. to output, to the control device 160, a signal for actuating the work equipment to the position for initiating the next excavation. Due to the signal from the aforementioned switch, the control device 160 controls the work equipment 130 so that the posture of the work equipment 130 becomes a preset goal posture different from that when excavation is initiated, as is the case with automated control according to the above-described embodiments.

The control device 160 according to the above-described embodiments controls the work equipment 130 based on the position P at the tip of the stick 132 or the arm 134. The position P at the tip of the stick 132 or the arm 134 may be the center of the tip of the stick 132 or the arm 134, or may be a position that is offset to the left or right. Additionally, in another embodiment, the work machine 130 may be controlled on the basis of an arbitrary position on the clam bucket 133 or the bucket 135 instead of the position P at the tip of the stick 132 or the arm 134.

The invention claimed is:

1. A control device for a loading machine, the loading machine including a swinging body that swings about a swing center, a traveling body that supports the swinging body, and work equipment that is composed of multiple link components including a work tool and that is attached to the swinging body, the control device comprising:

a processor configured to perform automated control for automatically moving the work tool from a position above a loading target to a goal position that is distanced from the loading target in a horizontal direction and that is lower than the loading target in a vertical direction perpendicular to the horizontal direction, and wherein the processor is configured to, during the automated control:

output an operation signal for swinging the swinging body until a portion of the swinging body to which the work equipment is attached faces the goal position, output an operation signal for upwardly actuating a first link component, which is one of the multiple link components, when the work tool is positioned above the loading target, output an operation signal for downwardly actuating a second link component, which is one of the multiple link components, when the work tool is positioned above the loading target, and output an operation signal for downwardly actuating the first link component and the second link component when the work tool is not positioned above the loading target.

2. The control device for the loading machine according to claim 1, wherein:

a required actuation time period of the first link component to transition from a posture when the work tool is positioned above the loading target to a posture when the work tool is positioned at the goal position is shorter than a required actuation time period of the second link component.

3. The control device for the loading machine according to claim 1, wherein the processor is configured to actuate the first link component and the second link component so that a height of a lowest point of the work tool is not lowered while the work tool is positioned above the loading target.

4. The control device for the loading machine according to claim 3, wherein the processor is configured to actuate the first link component and the second link component so that the height of the lowest point of the work tool is maintained while the work tool is positioned above the loading target.

5. The control device for the loading machine according to claim 3, wherein the processor is configured to actuate the first link component and the second link component so that, while the work tool is positioned above the loading target, the height of the lowest point of the work tool is higher than the lowest point of the work tool at a time the automated control is initiated.

6. The control device for the loading machine according to claim 1, wherein the work equipment comprises:

a boom provided on the swinging body, a stick provided on a tip of the boom, and the work tool provided on a tip of the stick so that an opening faces forward relative to the swinging body, wherein the first link component is the boom, and wherein the second link component is the stick and the work tool.

7. The control device for the loading machine according to claim 1, wherein the work equipment comprises:

a boom provided on the swinging body, an arm provided on a tip of the boom, and the work tool provided on a tip of the arm so that an opening faces forward relative to the swinging body, wherein the first link component includes at least one of the arm or the work tool, and wherein the second link component includes the boom.

8. The control device for the loading machine according to claim 1, wherein the processor is configured to, during the automated control, output an operation signal for downwardly actuating the second link component so as to cancel out a change in height of a lowest point of the work tool due to upward movement of the first link component when the work tool is positioned above the loading target.

9. A loading machine control method for moving a work tool on a loading machine, the loading machine including a swinging body that swings about a swing center, a traveling body that supports the swinging body, and work equipment that is composed of multiple link components including the work tool and that is attached to the swinging body, the loading machine control method comprising:

moving the work tool from a position above a loading target to a goal position that is distanced from the loading target in a horizontal direction and that is lower than the loading target in a vertical direction perpendicular to the horizontal direction, wherein moving the work tool comprises:

outputting an operation signal for swinging the swinging body until a portion of the swinging body to which the work equipment is attached faces the goal position;

outputting an operation signal for upwardly actuating a first link component, which is one of the multiple link components, when the work tool is positioned above the loading target;

outputting an operation signal for downwardly actuating a second link component, which is one of the multiple link components, when the work tool is positioned above the loading target, and outputting an operation signal for downwardly actuating the first link component and the second link component when the work tool is not positioned above the loading target.

10. A control system for a loading machine, the loading machine including a swinging body that swings about a swing center, a traveling body that supports the swinging body, and work equipment that is composed of multiple link components including a work tool and that is attached to the swinging body, the control system comprising:

one or more computers at least partially provided outside the loading machine and configured to perform automated control for automatically moving the work tool from a position above a loading target to a goal position that is distanced from the loading target in a horizontal direction and that is lower than the loading target in a vertical direction perpendicular to the horizontal direction, wherein the one or more computers are configured to, during the automated control:

output an operation signal for swinging the swinging body until a portion of the swinging body to which the work equipment is attached faces the goal position, output an operation signal for upwardly actuating a first link component, which is one of the multiple link components, when the work tool is positioned above the loading target, output an operation signal for downwardly actuating a second link component, which is one of the multiple link components, when the work tool is positioned above the loading target, and output an operation signal for downwardly actuating the first link component and the second link component when the work tool is not positioned above the loading target.

* * * * *